US010562323B2

(12) United States Patent
Ohtake et al.

(10) Patent No.: US 10,562,323 B2
(45) Date of Patent: Feb. 18, 2020

(54) CONVEYING DEVICE, PRINTING APPARATUS, AND DRYING DEVICE

(71) Applicants: Mitsuo Ohtake, Kanagawa (JP); Masato Ogawa, Kanagawa (JP); Kohki Asada, Tokyo (JP); Ryohei Ito, Kanagawa (JP)

(72) Inventors: Mitsuo Ohtake, Kanagawa (JP); Masato Ogawa, Kanagawa (JP); Kohki Asada, Tokyo (JP); Ryohei Ito, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/923,210

(22) Filed: Mar. 16, 2018

(65) Prior Publication Data

US 2018/0264852 A1 Sep. 20, 2018

(30) Foreign Application Priority Data

Mar. 17, 2017 (JP) ..... 2017-053745
Feb. 22, 2018 (JP) ..... 2018-029388

(51) Int. Cl.
*B41J 11/00* (2006.01)
*B41J 13/08* (2006.01)
(Continued)

(52) U.S. Cl.
CPC ..... *B41J 11/0085* (2013.01); *B41J 11/002* (2013.01); *B41J 13/08* (2013.01);
(Continued)

(58) Field of Classification Search
CPC ..... B41J 11/0085; B41J 11/002; B41J 11/007; B41J 13/0009; B41J 11/02; B41J 13/08; B65H 5/224; B65H 29/242; B65H 37/00
(Continued)

(56) References Cited

U.S. PATENT DOCUMENTS

2002/0109768 A1* 8/2002 Greive ..... B41J 11/0085 347/104
2016/0130102 A1* 5/2016 Nitta ..... B41J 13/223 271/265.01

(Continued)

FOREIGN PATENT DOCUMENTS

DE 10 2017 208 741 A 11/2017
JP 7-25007 A 1/1995

(Continued)

OTHER PUBLICATIONS

Extended European Search Report dated Aug. 10, 2018 in Patent Application No. 18161556.8, 8 pages.

*Primary Examiner* — Jannelle M Lebron
(74) *Attorney, Agent, or Firm* — Oblon, McClelland, Maier & Neustadt, L.L.P.

(57) ABSTRACT

A conveying device to convey a conveyed object includes a supporter, a blower, a negative pressure generator, and a divider. The supporter has a front surface to support the conveyed object. The supporter has an air-permeable structure. The blower blows air toward the front surface of the supporter. The negative pressure generator creates a negative pressure state in a space at a back surface side of the supporter. The negative pressure generator includes a suction unit to suck air in the space through a plurality of suction ports. The suction ports are disposed away from and opposed to a back surface of the supporter. The divider is disposed away from the back surface of the supporter between the suction ports and the back surface of the supporter in the space. The divider has a plurality of ventilation holes smaller in opening area than each of the suction ports.

21 Claims, 14 Drawing Sheets

(51) Int. Cl.
*B65H 29/24* (2006.01)
*B41M 5/00* (2006.01)
*B65H 37/00* (2006.01)

(52) U.S. Cl.
CPC ..... *B41M 5/0017* (2013.01); *B65H 29/242* (2013.01); *B65H 37/00* (2013.01)

(58) Field of Classification Search
USPC ..... 347/16, 101, 104
See application file for complete search history.

(56) References Cited

U.S. PATENT DOCUMENTS

| | | | |
|---|---|---|---|
| 2017/0266987 | A1 | 9/2017 | Asada et al. |
| 2017/0266988 | A1 | 9/2017 | Asada et al. |
| 2017/0266989 | A1 | 9/2017 | Ogawa et al. |
| 2017/0334218 | A1 | 11/2017 | Ogawa et al. |
| 2018/0016106 | A1 | 1/2018 | Asada et al. |

FOREIGN PATENT DOCUMENTS

| | | |
|---|---|---|
| JP | 2005-075475 | 3/2005 |
| JP | 2008-230820 | 10/2008 |
| JP | 2008-280173 | 11/2008 |
| JP | 2010-111507 | 5/2010 |
| JP | 2012-206303 | 10/2012 |
| JP | 2014-125342 | 7/2014 |
| JP | 2014-210641 | 11/2014 |
| JP | 2016-150792 | 8/2016 |
| JP | 2016-150794 | 8/2016 |
| JP | 2016-150796 | 8/2016 |
| JP | 2017-171501 | 9/2017 |
| JP | 2017-171502 | 9/2017 |
| JP | 2017-171503 | 9/2017 |
| JP | 2017-210371 A | 11/2017 |

* cited by examiner

CONVEYING DEVICE, PRINTING APPARATUS, AND DRYING DEVICE

CROSS-REFERENCE TO RELATED APPLICATIONS

This patent application is based on and claims priority pursuant to 35 U.S.C. § 119(a) to Japanese Patent Application Nos. 2017-053745, filed on Mar. 17, 2017, and 2018-029388, filed on Feb. 22, 2018, in the Japan Patent Office, the entire disclosure of which is incorporated by reference herein.

BACKGROUND

Technical Field

Aspects of the present disclosure relate to a conveying device, a printing apparatus, and a drying device.

Related Art

A conveying device is known that includes a supporter having an air-permeable structure and creates a negative pressure state in a space at a back surface side of the supporter to attract a conveyed object on a front surface of the supporter and convey the conveyed object.

SUMMARY

In an aspect of the present disclosure, there is provided a conveying device to convey a conveyed object. The conveying device includes a supporter, a blower, a negative pressure generator, and a divider. The supporter has a front surface to support the conveyed object. The supporter has an air-permeable structure. The blower blows air toward the front surface of the supporter. The negative pressure generator creates a negative pressure state in a space at a back surface side of the supporter. The negative pressure generator includes a suction unit to suck air in the space through a plurality of suction ports. The plurality of suction ports is disposed away from and opposed to a back surface of the supporter. The divider is disposed away from the back surface of the supporter between the plurality of suction ports and the back surface of the supporter in the space. The divider has a plurality of ventilation holes smaller in opening area than each of the plurality of suction ports.

In another aspect of the present disclosure, there is provided a printing apparatus includes a liquid discharge device to discharge liquid onto a conveyed object and the above-described conveying device to convey the conveyed object.

In still another aspect of the present disclosure, there is provided a drying device comprising the above-described conveying device. The blower applies wind to the conveyed object to dry the conveyed object.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
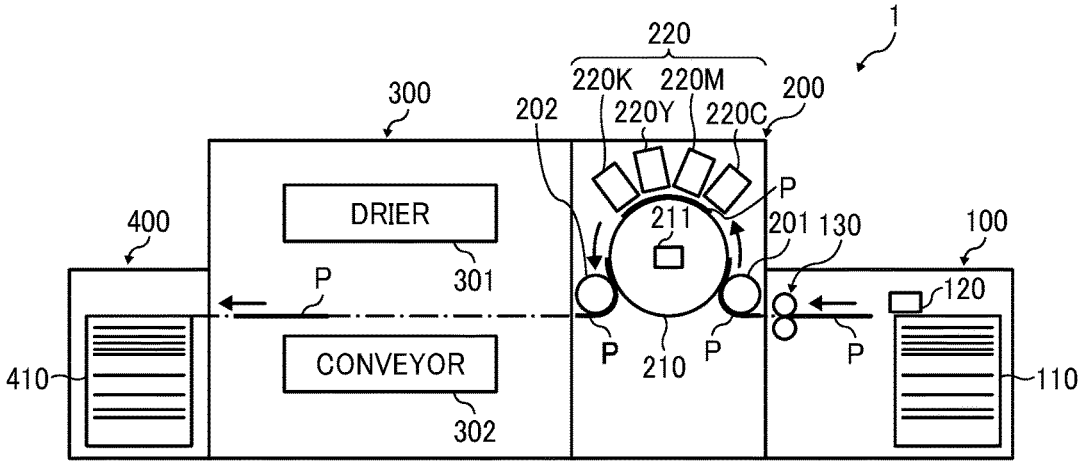
FIG. 1 is a schematic view of a configuration of an inkjet recording apparatus as a printing apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Overall Description

FIG. 1 is a schematic view of a configuration of an inkjet recording apparatus as a printing apparatus according to an embodiment of the present disclosure. An inkjet recording apparatus 1 according to the present embodiment includes, for example, a sheet feeding unit 100, an image forming unit 200, a drying unit 300, and a sheet ejection unit 400. In the inkjet recording apparatus 1, an image is formed on a sheet P, which is a recording material as a sheet material fed from the sheet feeding unit 100, with ink that is a liquid for image formation in the image forming unit 200. After the ink adhered to the sheet is dried in the drying unit 300, the sheet is ejected from the sheet ejection unit 400. The drying unit 300 is also a "drying device" according to an embodiment of the present disclosure.

Sheet Feeding Unit

The sheet feeding unit 100 includes, for example, a sheet feed tray 110 on which a plurality of sheets P is stacked, a sheet feeder 120 to separate and feed the sheets P one by one from the sheet feed tray 110, and paired registration rollers 130 to send the sheet P to the image forming unit 200. As the sheet feeder 120, any sheet feeder, such as a device using rollers or a device using air suction, can be used. After the leading end of the sheet fed from the sheet feed tray 110 by the sheet feeder 120 reaches the paired registration rollers 130, the paired registration rollers 130 are driven at a predetermined timing to feed the sheet to the image forming unit 200. In the present embodiment, the sheet feeding unit 100 is not limited to the above-described configuration and may be any other configuration capable of sending the sheet P to the image forming unit 200.

Image Forming Unit

The image forming unit 200 includes, for example, a transfer cylinder 201 to receive the fed sheet P and transfer the fed sheet P to a sheet bearing drum 210, a sheet bearing drum 210 to bear and convey the sheet P conveyed by the transfer cylinder 201 on an outer circumferential surface of the sheet bearing drum 210, an ink discharge unit 220 to discharge ink toward the sheet P borne on the sheet bearing drum 210, and a transfer cylinder 202 to transfer the sheet P conveyed by the sheet bearing drum 210 to the drying unit 300.

The leading end of the sheet P conveyed from the sheet feeding unit 100 to the image forming unit 200 is gripped by a sheet gripper provided on the surface of the transfer cylinder 201 and conveyed with the movement of the surface of the transfer cylinder 201. The sheet conveyed by the transfer cylinder 201 is delivered to the sheet bearing drum 210 at a position opposed to the sheet bearing drum 210.

The sheet gripper is also disposed on the surface of the sheet bearing drum 210, and the leading end of the sheet is gripped by the sheet gripper. A plurality of suction holes are dispersedly formed on the surface of the sheet bearing drum 210, and a suction air flow directed toward the inside of the sheet bearing drum 210 is generated in each suction hole by a suction device 211. The leading end of the sheet P delivered from the transfer cylinder 201 to the sheet bearing drum 210 is gripped by the sheet gripper, and the sheet is attracted to the surface of the sheet bearing drum 210 by the suction air flow and is conveyed with the movement of the surface of the sheet bearing drum 210.

The ink discharge unit 220 as a liquid discharge device according to the present embodiment discharges inks of four colors of C (cyan), M (magenta), Y (yellow), and K (black) to form an image, and includes individual liquid discharge heads 220C, 220M, 220Y and 220K for respective inks. The configurations of the liquid discharge heads 220C, 220M, 220Y, and 220K are not limited to the above-described configurations and may be any other configuration suitable for discharging liquid. The ink discharge unit 220 may include, for example, a liquid discharge head to discharge special ink, such as white, gold, and silver, or a liquid discharge head to discharge a liquid that does not constitute an image, such as a surface coating liquid, as needed.

The discharge operation of the liquid discharge heads 220C, 220M, 220Y, and 220K of the ink discharge unit 220 is controlled by drive signals corresponding to image information. When the sheet P borne on the sheet bearing drum 210 passes through a region opposed to the ink discharge unit 220, ink of respective colors is discharged from the liquid discharge heads 220C, 220M, 220Y, and 220K to form an image in accordance with the image information. In the present embodiment, the configuration of the image forming unit 200 is not limited to the above-described configuration and may be any other configuration of forming an image by causing liquid to adhere onto the sheet P.

Drying Unit

The drying unit 300 includes, for example, a drier 301 to dry the ink adhered onto the sheet P by the image forming unit 200, and a conveyor 302 to convey the sheet P conveyed from the image forming unit 200. After the sheet P conveyed from the image forming unit 200 is received by the conveyor 302, the sheet is conveyed to pass through the drier 301 and delivered to the sheet ejection unit 400. When the sheet P passes the drier 301, the ink on the sheet P is subjected to a drying process. Thus, the liquid content, such as moisture, in the ink evaporates, the ink is fixed on the sheet P, and the curl of the sheet P is reduced.

Sheet Ejection Unit

The sheet ejection unit 400 includes, for example, a sheet ejection tray 410 on which a plurality of sheet P is stacked. The sheet P conveyed from the drying unit 300 is sequentially stacked and held on the sheet ejection tray 410. In the present embodiment, the configuration of the sheet ejection unit 400 is not limited to the above-described configuration and may be any other configuration capable of ejecting the sheet P.

Other Functional Units

The inkjet recording apparatus 1 according to the present embodiment includes the sheet feeding unit 100, the image forming unit 200, the drying unit 300, and the sheet ejection unit 400. In addition, other functional units may be suitably added. For example, a pre-processing unit to perform pre-processing of image formation can be added between the sheet feeding unit 100 and the image forming unit 200, or a post-processing unit to perform post-processing of image formation can be added between the drying unit 300 and the sheet ejection unit 400.

As the pre-processing unit, for example, there is a unit to perform a treatment liquid application process of applying a treatment liquid for reacting with ink to reduce bleeding to the sheet P. However, the content of the pre-processing is not particularly limited to any specific content. In addition, as the post-processing unit, for example, there is a sheet reverse conveyance processing with the image formed by the image forming unit 200 and sending the sheet to the image forming unit 200 again to form images on both sides of the sheet, or a process for binding a plurality of sheets on which the image is formed, and the like. However, the content of the post-processing is also not particularly limited to any specific content.

In the present embodiment, the printing apparatus is described using an example of an inkjet recording apparatus. However, the "printing apparatus" is not limited to an apparatus that includes a liquid discharge head to discharge liquid toward a surface to be dried of the sheet material, and to make visible significant images, such as letters and graphics, with the discharged liquid. For example, the "printing apparatus" may also be an apparatus to form patterns and the like which have no meaning. The material of the sheet material is not limited, and any sheet material, such as paper, thread, fiber, cloth, leather, metal, plastic, glass, wood, and ceramics, to which liquid can temporarily adhere may be used. For example, sheet materials used for film products, cloth products, such as clothing products, building materials, such as a wall sheet or flooring materials, leather products, and the like may be used. The "printing apparatus" can also include units relating to feeding, conveying, and ejection of a sheet to which liquid can adhere, a pre-processing device, a post-processing device and the like. Further, the term "liquid" includes any liquid having a viscosity or a surface tension that can be discharged from the head. The "liquid" is not limited to a particular liquid and may be any liquid having a viscosity or a surface tension to be discharged from a head. However, preferably, the viscosity of the liquid is not greater than 30 mPa·s under ordinary temperature and ordinary pressure or by heating or cooling. More specifically, the "liquid" is, for example, solution, suspension, emulsion or the like that includes a solvent, such as water or an organic solvent, a colorant, such as a dye or a pigment, a functionalizing material, such as a polymerizable compound, a resin, or a surfactant, a biocompatible material, such as DNA, amino acid, protein, or calcium, edible materials, such as natural colorants, and the like. Such liquids can be used, for example, for inkjet inks, surface treatment liquids and the like. Although there is an apparatus in which the liquid discharge head and the sheet material relatively move as the "printing apparatus", embodiments of the present disclosure are not limited to such an apparatus. The "printing apparatus" may be, for example, a serial-type apparatus to move a liquid discharge head relative to a sheet material or a line-type apparatus that does not move a liquid discharge head relative to a sheet material.

Further, the term "liquid discharge head" represents a functional component to discharge and jet liquid from discharge orifices (nozzles). As an energy generating source to discharge liquid, a discharge energy generator, for example, a piezoelectric actuator (lamination-type piezoelectric element and thin-film piezoelectric element), a thermal actuator using an electrothermal transducer element, such as a heating resistor (element), or an electrostatic actuator including a diaphragm plate and opposed electrodes can be used. However, the energy generating source is not limited to any specific type and may be any other suitable discharge energy generator.

Details of Drying Unit

Figure 2:
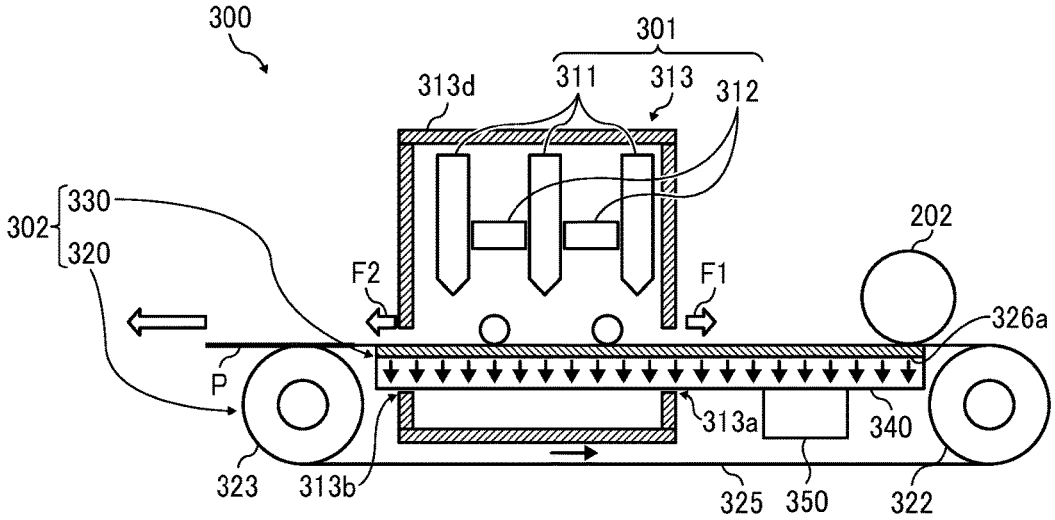
FIG. 2 is a front view of a drying unit of the inkjet recording apparatus of FIG. 1.
Figure 3:
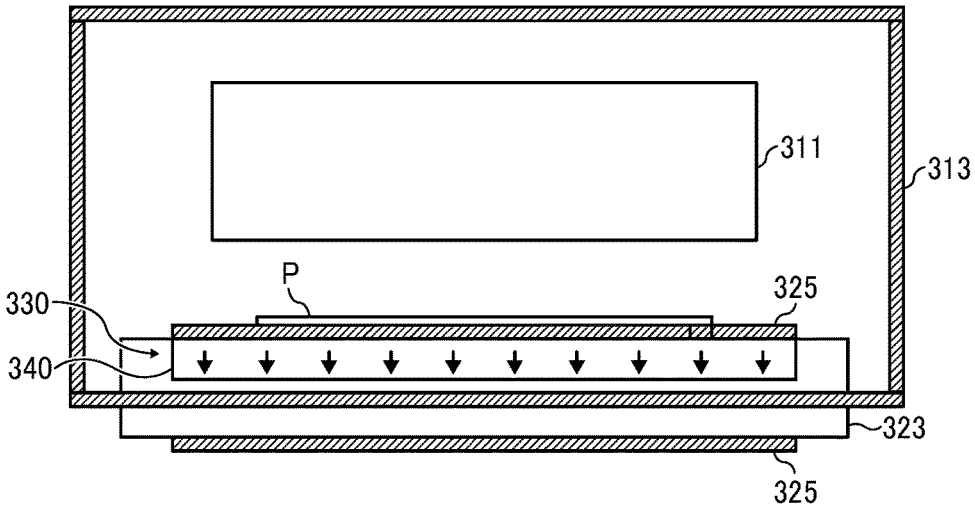
FIG. 3 is a cross-sectional view of the drying unit cut along a plane perpendicular to a sheet conveyance direction.

Next, the drying unit 300 in the present embodiment is further described below. FIG. 2 is a front view of the drying unit 300 in the present embodiment. FIG. 3 is a cross-sectional view of the drying unit 300 in the present embodiment, cut along a plane perpendicular to a sheet conveyance direction (indicated by arrow D in FIG. 5) in which a sheet P is conveyed by the conveyor 302.

The drier 301 in the drying unit 300 in the present embodiment includes, for example, a blower fan 311 to blow air toward the sheet P conveyed by the conveyor 302, a radiation heater 312 as a heater to radiate radiant heat (for example, infrared rays), and a drying chamber 313 formed by surrounding the periphery of the blowing region blown by the blower fan 311 with a wall member 313*d*. At least a part of the wall member 313*d* of the drying chamber 313 is formed of a heat insulating material so that the internal temperature of the drying chamber 313 is not easily lowered. In the drier 301, the ink on the image surface of the sheet P is dried by the radiant heat of the radiation heater 312 and the air blown by the blower fan 311 with respect to the image surface of the sheet P conveyed to the internal space of the drying chamber 313.

In the drier 301 of the present embodiment, a plurality of (three in the present embodiment) blower fans 311 is disposed side by side in the sheet conveyance direction. However, the number and arrangement of the blower fans 311 are not limited to any particular number and arrangement and may be any other suitable number and an air-permeable structure. In the drier 301 of the present embodiment, a plurality (two in the embodiment) of the radiation heaters 312 is disposed side by side in the sheet conveyance direction. However, the number and arrangement of the radiation heaters 312 are also not limited to any particular number and arrangement and may be any other suitable number and arrangement.

The conveyor 302 of the present embodiment includes, for example, a belt conveyance assembly 320 and a suction assembly 330. The belt conveyance assembly 320 bears the sheet P on the surface of an endless conveyance belt 325 stretched between the two support rollers 322 and 323, and conveys the sheet P in accordance with the movement of the surface of the conveyance belt 325. The length of the conveyance belt 325 in a direction (width direction) perpendicular to the sheet conveyance direction is set to be equal to or greater than the length of the conveyed sheet P in the width direction.

The conveyance belt 325 travels as at least one of the two support rollers 322 and 323 is driven, and the surface of the conveyance belt 325 moves in the direction of an arrow in the FIG. 2. The conveyance belt 325 according to the present embodiment is a suction belt having an air-permeable structure in which a plurality of minute through holes (suction holes) are open in a dispersed manner on the surface thereof. A suction assembly 330 is disposed on an inner circumferential face side of a belt portion (a belt portion in which the first support roller 322 moves toward the second support roller 323).

Figure 4:
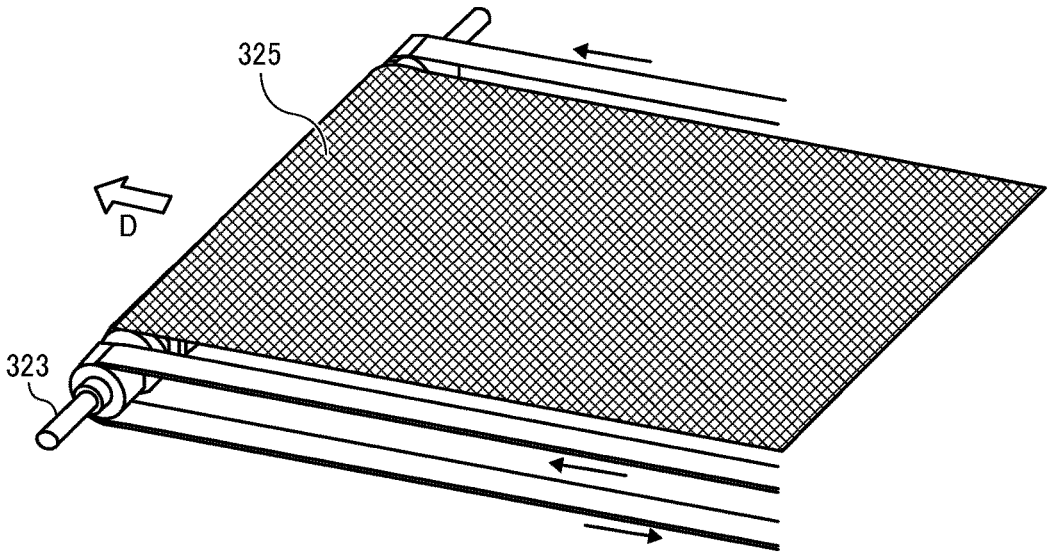
FIG. 4 is an illustration of an example of a conveyance belt of the drying unit.
Figure 5:
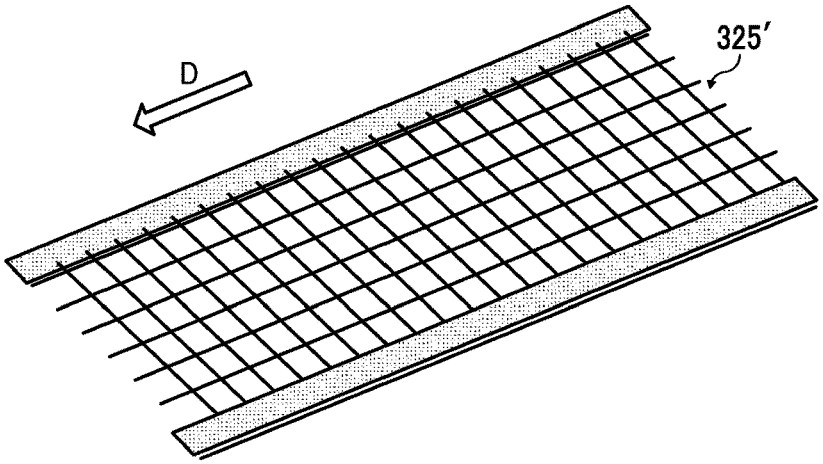
FIG. 5 is an illustration of another example of the conveyance belt of the drying unit.

A supporter according to the present embodiment to support a sheet of paper, which is a sheet material as a conveyed object, may have an air-permeable structure. For example, as illustrated in FIG. 4, the supporter may be the conveyance belt 325 in which linear members are formed in a meshed shape. Alternatively, as illustrated in FIG. 5, the supporter may have a structure to support the sheet on a plurality of supporting wires 325' or may be a porous member. In the air-permeable structure of the supporter, the greater the gaps through which the air from the blower fan 311 passes, the less the momentum of the air flow toward a leading end portion of the sheet P decreases, thus effectively reducing the fluttering of the leading end portion of the sheet P. The area of the supporter contacting the back side of the sheet also decreases, thus effectively suppressing drying unevenness of the sheet P. However, it is necessary to take into consideration that deflection of the sheet P does not occur due to a reduction in the area of the supporter supporting the sheet P.

An upstream portion of the conveyance belt 325 in the sheet conveyance direction (a belt portion wound around the first support roller 322) is disposed opposite to the transfer cylinder 202 of the image forming unit 200. The sheet P conveyed by the transfer cylinder 202 is delivered to the conveyance belt 325 in such a manner that a back side of the image surface faces a front side of the conveyance belt 325, and the sheet P is borne on the surface of the conveyance belt 325. The sheet P borne on the surface of the conveyance belt 325 is conveyed to the side of the second support roller 323 with the movement of the surface of the conveyance belt 325.

A belt portion (a belt portion that moves from the first support roller 322 to the second support roller 323) that bears the sheet on the conveyance belt 325 is disposed to pass through the inside of the drying chamber 313 of the drier 301. Accordingly, the sheet P borne on the surface of the conveyance belt 325 passes through the inside of the drying chamber 313 of the drier 301 with the movement of the surface of the conveyance belt 325. After that, the sheet P is separated from the surface of the conveyance belt 325, and is delivered to the sheet ejection unit 400 via a guide plate, a conveyance roller, or the like.

The suction assembly 330 includes, mainly, a suction chamber 340 and a suction device 350 to suck air in the suction chamber 340. The inside of the suction chamber 340 is brought into a negative pressure state by the suction of the suction device 350. Accordingly, a suction air flow directed toward the inside of the suction chamber 340 is generated above the suction chamber 340. By the suction air flow, the inner circumferential face (back surface) of the conveyance belt 325 is attracted to an upper portion of the suction chamber 340 and moves while sliding on the upper portion of the suction chamber 340.

In addition, due to the suction air flow generated in the upper portion of the suction chamber 340, a suction air flow also occurs in suction holes formed in the conveyance belt 325. As a result, the sheet P conveyed by the transfer cylinder 202 and delivered onto the surface of the conveyance belt 325 is attracted onto the surface of the conveyance belt 325 by the suction air flow. Along with the movement of the surface of the conveyance belt 325, the sheet passes through the inside of the drying chamber 313 of the drier 301. After that, the sheet is separated from the surface of the conveyance belt 325 and delivered to the sheet ejection unit 400.

Metal, rubber, or the like can be used as the material of the conveyance belt 325, and the material is not particularly limited. However, in the present embodiment, it may be preferable to use a heat-resistant material (heat-resistant rubber, metal, or the like) in consideration of being exposed to a high temperature when passing through the inside of the drying chamber 313.

In the present embodiment, the sheet P is attracted to the surface of the conveyance belt 325 by the suction force generated by the suction air flow, which is generated by the suction assembly 330, and conveyed along with the movement of the surface of the conveyance belt 325. In some embodiments, a conveyance member may be disposed to convey the sheet P so that the sheet P relatively move with respect to the surface of the conveyance belt 325. For example, a conveyance member that grips a leading end of the sheet with the sheet gripper and conveys the sheet along the surface of the conveyance belt 325, or a conveyance member that applies a conveying force to the sheet and moves on the surface of the conveyance belt 325 may be provided. In the case of providing such a conveyance member, it is not necessary for the conveyance belt 325 to move the surface of the conveyance belt 325.

Figure 6:
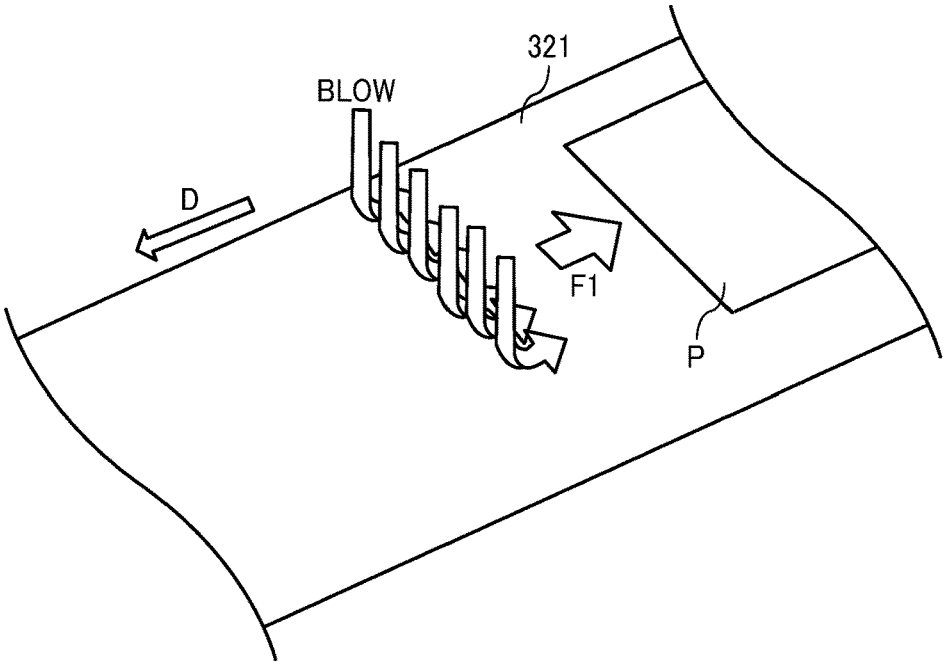
FIG. 6 is an illustration of a state in which, when the conveyance belt is a flat belt, wind from a blower fan hits on a surface of the conveyance belt and an air flow toward a leading end of a sheet, which enters into a blowing region from an upstream side in the sheet conveyance direction, is generated.

In the present embodiment, before the sheet P enters the blowing region (within the drying chamber 313 in the present embodiment) blown by the blower fan 311, air from the blower fan 311 hits the surface of the conveyance belt 325 existing in the blowing region. At this time, if the conveyance belt is a flat belt 321 having an air-impermeable structure, air hitting the surface of the flat belt 321 advances along the surface of the flat belt 321. Thus, as illustrated in FIG. 6, an air flow F1 is generated toward the leading end of the sheet P that enters the blowing region from the upstream side in the sheet conveyance direction. Such an air flow F1 rolls up the leading end of the sheet before the sheet P enters the blowing region. Thus, the leading end of the sheet is caught by a surrounding member, such as the wall member 313*d* of the drying chamber 313, or the sheet P is peeled off from the flat belt 321, which may lead to a conveyance failure.

However, in the present embodiment, since the conveyance belt is the conveyance belt 325 having the air-permeable structure, air hitting the surface of the conveyance belt 325 passes through the surface of the conveyance belt 325 and comes out to the back side of the conveyance belt 325. Accordingly, the momentum of the air flow F1 toward the leading end of the sheet P entering the blowing region from the upstream side in the sheet conveyance direction decreases, thus reducing the roll-up of the leading end of the sheet. As a result, a conveyance failure, such as the leading end of the sheet being caught on the surrounding member such as the wall member 313*d* of the drying chamber 313 is reduced, and stable sheet conveyance can be obtained.

Further, in the present embodiment, the blowing region is surrounded by the wall member 313*d* of the drying chamber 313. The drying chamber in of the present embodiment has a sheet inlet 313*a* to receive the sheet P from the upstream side in the sheet conveyance direction into the inside of the drying chamber 313, and a sheet outlet 313*b* to eject the sheet P from the inside of the drying chamber 313 to the downstream side in the sheet conveyance direction. The drying chamber 313 has no openings in other portions. Therefore, the air flow F1 generated by blowing of the blower fan 311 is easily blown out strongly from the inside of the drying chamber 313 toward the outside through the sheet inlet 313*a*. Therefore, the strong air flow F1 blown out from the sheet inlet 313*a* hits the leading end of the sheet P before entering from the sheet inlet 313*a* of the drying chamber 313, and the leading end of the sheet easily rolls up.

Therefore, in the present embodiment, the suction assembly 330 is disposed so that the sheet P can be attracted to the surface of the conveyance belt 325 from the upstream side to the downstream side of the sheet inlet 313*a* of the drying chamber 313 in the sheet conveyance direction. Thus, the leading end of the sheet P is continuously attracted to the surface of the conveyance belt 325 until the leading end of the sheet P passes through the sheet inlet 313*a*, and even if a strong air flow F1 is blown out from the sheet inlet 313*a*, the curling of the sheet leading end is stably reduced.

After the leading end of the sheet enters the blowing region in the drying chamber 313, the leading end of the sheet is pressed against the surface of the conveyance belt 325 by the air from the blower fan 311. Accordingly, in the blowing region, since the curling of the leading end of the sheet is unlikely to occur, it is not always required to attract the leading end of the sheet P to the conveyance belt 325 by the suction assembly 330. However, in the present embodiment, since the blowing region is inside the drying chamber 313, if the leading end of the sheet P rises in the blowing region, there is a risk that the sheet P remains within the drying chamber 313 due to the conveyance failure. In addition, in some cases, the trailing end of the sheet P rolls up in the blowing region, and in that case, there is also a risk that the sheet P may remain in the drying chamber 313 due to the conveyance failure.

Since the interior of the drying chamber 313 is a space with less opening, a work of taking out the sheet P with conveyance failure from the interior is not easy. Therefore, as far as possible, it is desirable to avoid an occurrence of conveyance failure inside the drying chamber 313. In addition, when heat generator, such as a radiation heater 312, is disposed inside the drying chamber 313 as in the present embodiment, it is also important to avoid a situation in which the sheet P comes into contact with the heat generator.

Therefore, in the present embodiment, there is a configuration in which the leading end and the trailing end of the sheet P are also continuously pressed by the suction assembly 330 inside the drying chamber 313 (inside the blowing region). Such a configuration stably reduces the curling of the leading end and the trailing end of the sheet P inside the drying chamber 313. Accordingly, the occurrence of a situation in which the sheet P remains in the drying chamber 313 or the sheet P comes into contact with the heat generator can be reduced.

Further, in the present embodiment, the configuration is employed in which the sheet P is attracted to the conveyance belt 325 by the suction assembly 330 inside the drying chamber 313 (inside the blowing region). With such a configuration, the sheet P can be stably conveyed by the conveyance belt 325, even if the sheet P is folded at corner or wrinkled. Thus, a conveyance failure, which may occur due to a fold being caught on the internal parts of the drying chamber 313 or the adhesion between the sheet P and the conveyance belt 325 being lowered by wrinkle, is unlikely to occur inside the drying chamber 313. Even if the fold or wrinkle occurs on the sheet P, such a configuration can reduce the occurrence of the situation where the sheet P remains inside the drying chamber 313.

Figure 7:
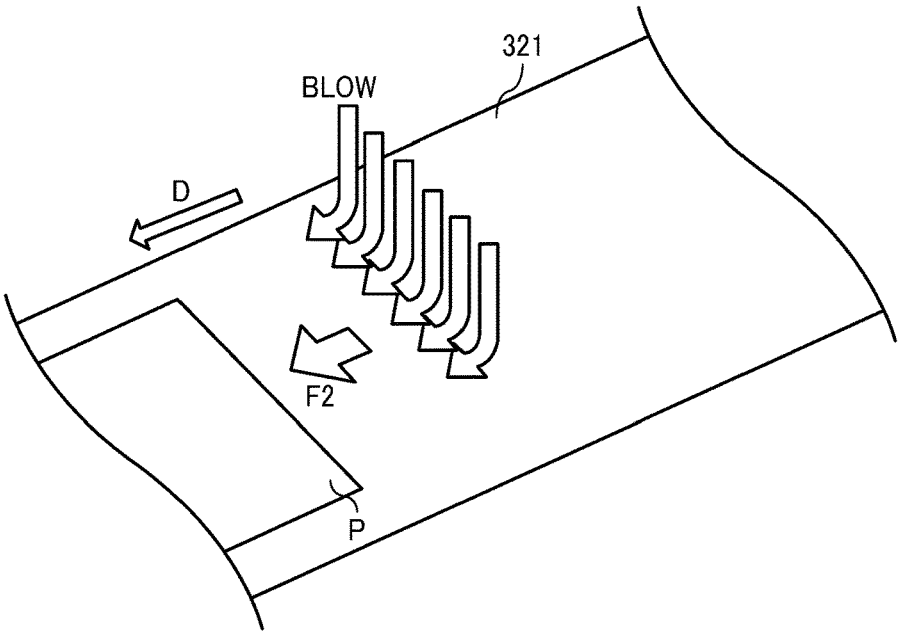
FIG. 7 is an illustration of a state in which, when the conveyance belt is a flat belt, with from the blower fan hits on the surface of the conveyance belt and an air flow toward a trailing end of the sheet, which has passed through the blowing region, is generated.

Further, in the present embodiment, even after the sheet P passes through the blowing region that is blown by the blower fan 311, air from the blower fan 311 hits the surface of the conveyance belt 325 existing in the blowing region. At this time, if the conveyance belt is a flat belt 321 having an air-impermeable structure, air hitting the surface of the flat belt 321 advances along the surface of the flat belt 321. Thus, as illustrated in FIG. 7, an air flow F2 is generated toward the trailing end of the sheet P that has passed from the blowing region to the downstream side in the sheet conveyance direction. Such an air flow F2 may cause a conveyance failure by curling the trailing end of the sheet P that has passed through the blowing region and peeling off the sheet P from the flat belt 321.

In the present embodiment, in the present embodiment, since the conveyance belt is the conveyance belt 325 having the air-permeable structure, air hitting the surface of the conveyance belt 325 passes through the surface of the conveyance belt 325 and comes out to the back side of the conveyance belt 325. Accordingly, the momentum of the air flow F2 toward the trailing end of the sheet P that has passed from the inside of the air blowing region to the downstream side in the sheet conveyance direction decreases, thus reducing the roll-up of the trailing end of the sheet. Thus, a stable sheet conveyance performance can be obtained.

In the present embodiment, like the above-described blowing-off of the air flow F1 from the sheet inlet 313*a*, the air flow F2 generated by the blowing of the blower fan 311 is easy to strongly blow out from the inside of the drying chamber 313 to the outside through the sheet outlet 313*b*. As a result, the strong air flow F2 blown out from the sheet outlet 313*b* hits the trailing end of the sheet P that has passed through the sheet outlet 313*b* of the drying chamber 313, and the trailing end of the sheet is liable to be curled.

In the present embodiment, the suction assembly 330 is disposed so that the sheet P can be attracted to the surface of the conveyance belt 325 from the upstream side to the downstream side of the sheet outlet 313*b* of the drying chamber 313 in the sheet conveyance direction. Therefore, even after the trailing end of the sheet P passes through the sheet outlet 313*b* before passing, the trailing end of the sheet P is continuously attracted to the surface of the conveyance belt 325. Thus, even if the strong air flow F2 is blown out from the sheet outlet 313*b*, the curling of the trailing end of the sheet is stably reduced.

The drying unit 300 of the present embodiment does not necessarily need to include a heat generator, such as the radiation heater 312, since the drying unit 300 includes a blower, such as the blower fan 311, to blow air toward the sheet P. However, the drying unit 300 preferably includes the heat generator to dry ink in a shorter time. The heat generator is not limited to a heat generator that generates a radiant heat such as the radiation heater 312. For example, a member generating heat transmitted from the member making contact with the sheet P such as the conveyance belt 325 to the sheet P may also be employed. In addition, a heat generator to raise the temperature inside the drying chamber 313 may also be employed. In such a case, the blower fan 311 may be used to blow warm air to the sheet P.

The blower fan 311 of the present embodiment incorporates a heater. Settings of various parameters, such as the temperature of the heater, the air speed and air volume of the blower fan 311, and the distance between the blower fan 311 and the surface of the conveyance belt 325, can be changed by a controller. The setting values of various parameters are changed in accordance with, for example, the type of the sheet P, the ink adhesion amount to the sheet P, the sheet conveyance speed of the conveyance belt 325, and the like. For example, the controller may change setting values of various parameters on the basis of input information that is input by an operator through a control panel provided in the inkjet recording apparatus 1, or may change the setting values of various parameters, using data or program stored in advance in the storage device. The various parameters can be manually adjusted by an operator.

Setting of parameters, such as the output wavelength of the radiation heater 312, are also changeable in accordance with the type of the sheet P, the ink adhesion amount to the sheet P, the sheet conveyance speed of the conveyance belt 325, and the like. For changing the setting of parameters, as in the case of the blower fan 311, for example, setting values of various parameters may be changed based on input information that is input by an operator through a control panel provided in the inkjet recording apparatus, or the setting values of various parameters may be changed, using data or programs stored in the storage device. Manual adjustment can also be performed by the operator.

All of the conveyance belt 325 according to the present embodiment are not disposed in the drying chamber 313, but a part of the conveyance belt 325 is disposed to pass through the outside of the drying chamber 313 as illustrated in FIGS. 2 and 3. Since the inside of the drying chamber 313 according to the present embodiment reaches a high temperature, the conveyance belt 325 might be exposed to the high temperature for a long time if the conveyance belt 325 is entirely disposed inside the drying chamber 313. This might increase the highest temperature of the conveyance belt 325 and reduce a service lifetime. According to the present embodiment, the conveyance belt 325 can be cooled when the conveyance belt 325 passes through the outside of the drying chamber 313. Therefore, it is possible to lower the highest temperature of the conveyance belt 325 and lengthen the service lifetime. In this case, a cooler capable of cooling the conveyance belt 325 passing through the outside of the drying chamber 313 may be provided. The cooler is not limited to any particular type of cooler. For example, an air-cooled cooling fan may be preferably employed.

Figure 8:
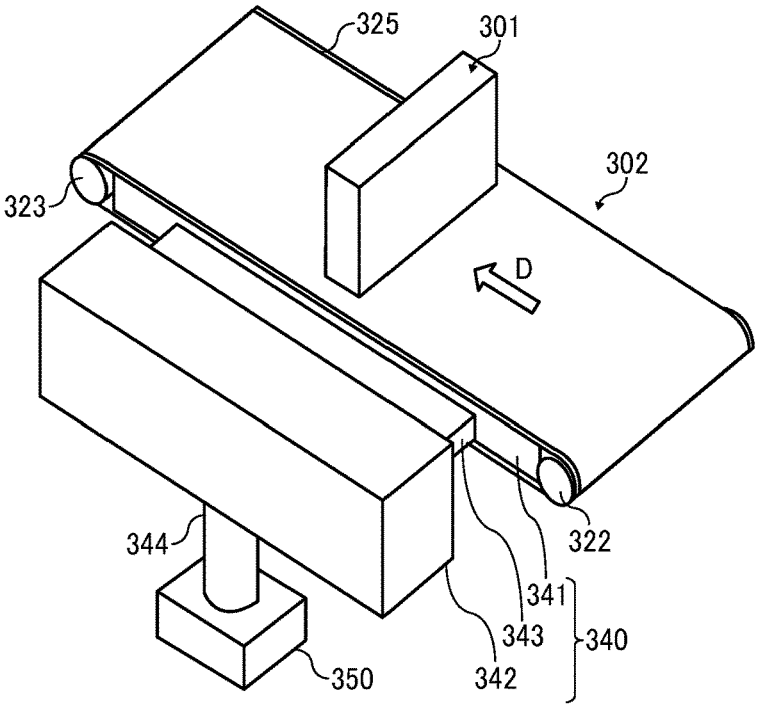
FIG. 8 is a perspective view of a configuration of the drying unit.
Figure 9:
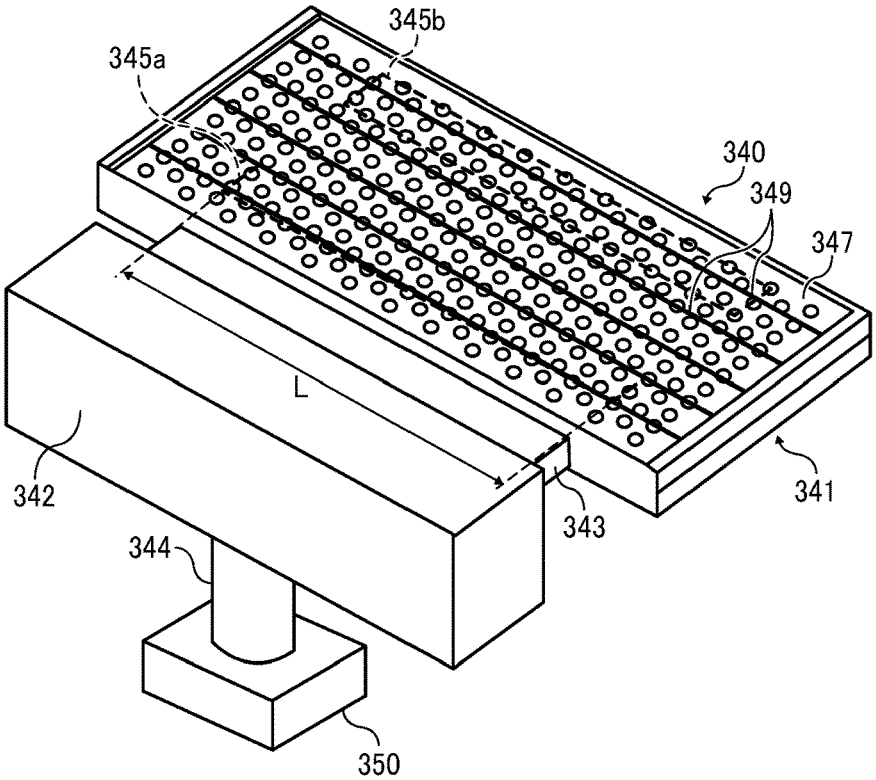
FIG. 9 is a perspective view of a suction assembly constituting a conveyance assembly of the drying unit.

Next, the configuration and operation of the suction assembly 330 in the present embodiment is described below. FIG. 8 is a perspective view of a configuration of the drying unit 300 in the present embodiment. FIG. 9 is a perspective view of the suction assembly 330 as a negative pressure generator constituting part of the conveyor 302 of the drying unit 300 in the present embodiment. The suction assembly 330 in the present embodiment mainly includes a suction chamber 341, a decompression chamber 342, a connection duct 343, and a suction duct 344. The suction chamber 341 is disposed in an in-belt space surrounded by an inner circumferential surface (back surface) of the conveyance belt 325. The decompression chamber 342 is disposed outside the in-belt space. The connection duct 343 serves as a connection passage to communicate the suction chamber 341 and the decompression chamber 342. The suction duct 344 connects the decompression chamber 342 and the suction device 350.

Figure 10:
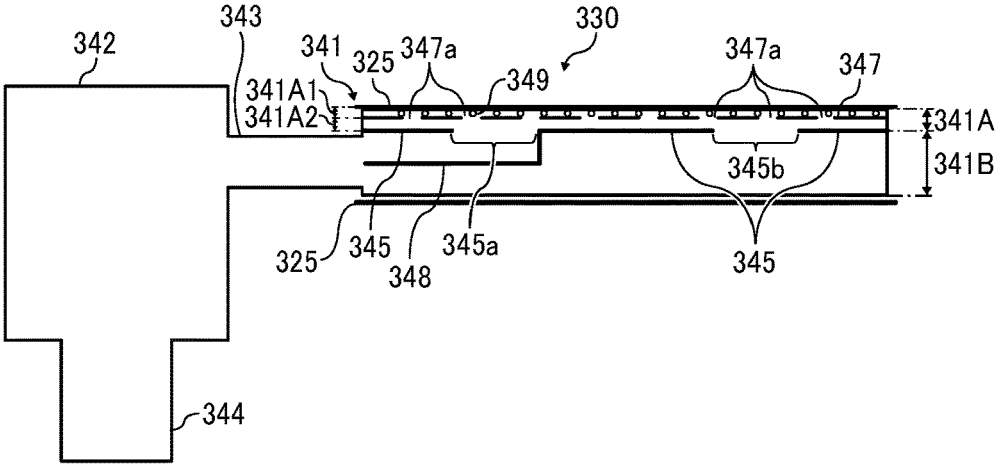
FIG. 10 is a cross-sectional view of an internal structure of a suction chamber in the suction assembly.

FIG. 10 is a cross-sectional view of an internal structure of the suction chamber 340 in the suction assembly 330 in the present embodiment. FIG. 10 is a schematic diagram of a cross section orthogonal to the sheet conveyance direction. The suction assembly 330 in the present embodiment acts as a negative pressure generator to create a negative pressure state in a back surface side space of the conveyance belt 325. The suction assembly 330 sucks the sheet P on the conveyance belt 325 with the suction device 350 through a plurality of suction ports 345*a* and 345*b*. The suction ports 345*a* and 345*b* are disposed at a distance from and opposed to the back side of a belt portion of the conveyance belt 325 to bear the sheet P.

In the present embodiment, the suction device 350 sucks the inside of the decompression chamber 342 through the suction duct 344 to create a negative pressure state inside the decompression chamber 342. The inside of the suction chamber 341 is sucked by the negative pressure inside decompression chamber 342 via the connection duct 343. The inside of the suction chamber 341 is vertically divided into an upper chamber portion 341A and a lower chamber portion 341B by a suction port plate 345. The upper chamber portion 341A and the lower chamber portion 341B communicate with each other through the plurality of suction ports 345*a* and 345*b* formed in the suction port plate 345.

The plurality of suction ports 345*a* and 345*b* are elongated through holes that are elongated in sheet conveyance direction. In the present embodiment, the suction ports 345*a* and 345*b* are open at positions opposed to both end portions of the sheet P in the width direction of the sheet P. In the present embodiment, an example in which the number of suction ports 345*a* and 345*b* sucked by the suction device 350 is described is described. Note that the number of suction ports is not limited to two and may be three or more.

In the present embodiment, when the suction device 350 performs suction, the suction duct 344, the decompression chamber 342, the connection duct 343, and the lower chamber portion 341B are sucked. Accordingly, suction air flows are generated in the suction ports 345*a* and 345*b* of the suction port plate 345, to suck the inside of the upper chamber portion 341A. As a result, the air (gas) in the upper chamber portion 341A is sucked into the lower chamber portion 341B, thus creating a negative pressure state inside the upper chamber portion 341A.

Figure 11:
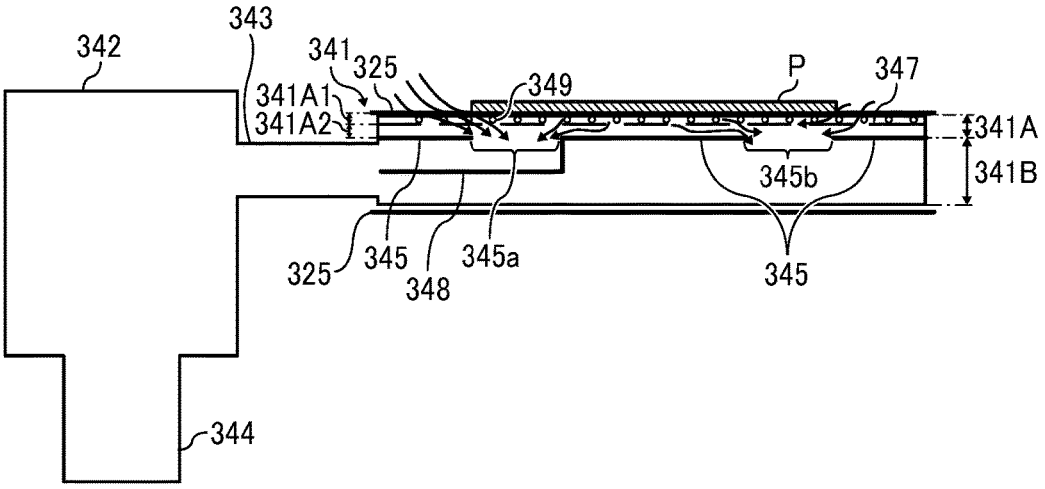
FIG. 11 is an illustration of an air flow in the suction assembly.

Here, in the case where the size of the sheet P on the conveyance belt 325 is such that the sheet P is not borne to completely cover the upper portion of the upper chamber portion 341A, as indicated by arrows in FIG. 11, air flows into the upper chamber portion 341A through an uncovered portion of the upper chamber portion 341A in which the upper chamber portion 341A is not covered with the sheet P. As a result, the air flows from the plurality of suction ports 345*a* and 345*b* into the lower chamber portion 341B, thus lowering the negative pressure state in the upper chamber portion 341A. Even in such a situation, since a relatively high degree of negative pressure state in a region in the upper chamber portion 341A close to the plurality of suction ports 345*a* and 345*b*, sufficient attraction force for attracting the sheet P can be generated on a portion of the conveyance belt 325 opposed to the plurality of suction ports 345*a* and 345*b* (in the vicinity of both ends of the sheet P in the width direction of the sheet P). As described later, a flow path restrictor 347 as a divider is disposed between each of the suction ports 345*a* and 345*b* in the upper chamber portion 341A and the back surface of the conveyance belt 325. The flow path restrictor 347 includes a plurality of ventilation holes 347*a* having a smaller opening area than each of the suction ports 345*a* and 345*b*. Such a configuration can generate attraction force at a portion of the conveyance belt 325 not opposed to the suction ports 345*a* and 345*b* (in the vicinity of the center of the sheet P in the width direction of the sheet P). Therefore, even if the sheet P on the conveyance belt 325 has a size not completely covering the upper portion of the upper chamber portion 341A, the sheet P can be conveyed with the sheet P attracted onto the conveyance belt 325.

However, in the configuration in which the plurality of suction ports 345*a* and 345*b* are sucked by the suction device 350 as in the present embodiment, it may be difficult to equalize the amount of air that can be sucked per unit time from the plurality of suction ports 345*a* and 345*b* (hereinafter referred to as "suction capability"). Therefore, the attraction force for attracting the sheet P on the conveyance belt 325 is biased toward a portion of the conveyance belt 325 that is opposed to suction ports with high suction capability, and the attraction force is insufficient at another portion of the conveyance belt 325 opposed to suction ports with low suction capability.

In the present embodiment, the suction port 345*a* is closer to the decompression chamber 342 while the suction port 345*b* is farther from decompression chamber 342. A suction flow path from each of the plurality of suction ports 345*a* and 345*b* to the common connection duct 343 is longer in the suction port 345*b* than the suction port 345*a*. Therefore, the flow path resistance is higher in the suction flow path of the suction port 345*b* than in the suction flow path of the suction port 345*a*, and the suction capability of the suction port 345*b* is lower than the suction capability of the suction port 345*a*.

In the present embodiment, to reduce the difference in suction capability between the suction port 345*a* and the suction port 345*b*, a partition 348 is disposed in the lower chamber portion 341B to partition the suction flow paths from the plurality of suction ports 345*a* and 345*b* to the common connection duct 343. The partition 348 allows adjustment of the flow-path sectional area (the sectional area orthogonal to the flow path direction) of each of the partitioned suction flow paths. For example, by adjusting the flow-path sectional area of the suction flow path of the suction port 345*b* having a greater suction flow path length to be relatively large, the difference in flow path resistance between the suction port 345*a* and the suction port 345*b* can be reduced, thus allowing a reduction in the difference in suction capability between the suction port 345*a* and the suction port 345*b*.

Further, in the present embodiment, as illustrated in FIG. 10 and FIG. 11, the flow path restrictor 347 as the divider is disposed between the plurality of suction ports 345*a* and 345*b* in the upper chamber portion 341A and the back surface of the conveyance belt 325. The flow path restrictor 347 as the divider includes at least one ventilation holes 347*a*, having a smaller opening area than each of the suction ports 345*a* and 345*b*, at the position opposed to each of the suction ports 345*a* and 345*b*. Accordingly, the upper chamber portion 341A in the present embodiment is vertically divided into a first upper chamber portion 341A1 and a second upper chamber portion 341A2 by the flow path restrictor 347. As a result, in the present embodiment, the air flowing into the first upper chamber portion 341A1 from the uncovered portion of the conveyance belt 325 not covered by the sheet P further passes through the ventilation holes 347*a* of the flow path restrictor 347, flows into the second upper chamber portion 341A2, and is sucked out from the plurality of suction ports 345*a* and 345*b*.

Figure 12:
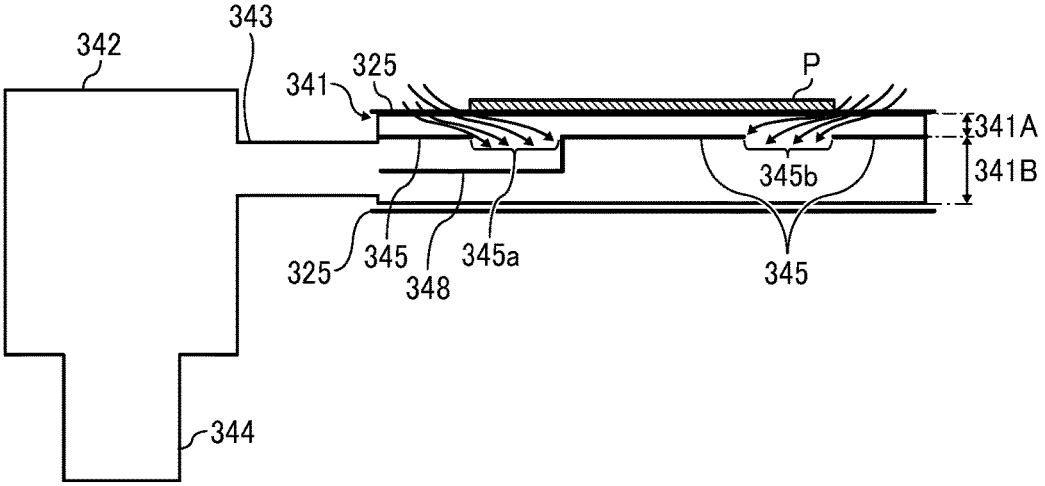
FIG. 12 is an illustration of an air flow in a suction assembly not including a flow path restrictor.

In the present embodiment, one or a plurality of ventilation holes 347*a* provided in the portions of the flow path restrictor 347 opposed to the suction ports 345*a* and 345*b* have an opening area (a total opening area of the plurality of ventilation holes, if the number of ventilation holes 347*a* are two or more) smaller than each of suction ports 345*a* and 345*b*. Accordingly, the flow path resistance while the air having flown into the upper chamber portion 341A flows toward each of the suction ports 345*a* and 345*b* is greater than the configuration in which the flow path restrictor 347 is not provided as illustrated in FIG. 12. As a result, the ratio between the air sucked from the suction port 345*a* having a high suction capability and the air sucked from the suction port 345*b* having a low suction capability in the air quantity per unit time sucked by the suction device 350 is changed, thus allowing a reduction in the difference in suction capability between the suction ports 345*a* and 345*b*. As a result, the bias of the attraction force for attracting the sheet P on the conveyance belt 325 can be reduced, thus enhancing the conveyance performance of the sheet P.

The opening area of the ventilation holes 347*a* of the flow path restrictor 347 relative to each of the suction ports 345*a* and 345*b* is appropriately set in consideration of, for example, the flow path resistance of the suction flow path from each of the plurality of suction ports 345*a* and 345*b* to the common connection duct 343. The shape of the ventilation holes 347*a*, the number of ventilation holes 347*a* to be opposed to the suction ports 345*a* and 345*b*, and the like are also appropriately set.

In the present embodiment, to obtain the effect of reducing the difference in the suction capability between the suction ports 345*a* and 345*b*, the ventilation holes 347*a* are not necessarily formed in portions of the flow path restrictor 347 not opposed to the suction ports 345*a* and 345*b*. However, the ventilation holes 347*a* may also be formed in the portions of the flow path restrictor 347 not opposed to the suction ports 345*a* and 345*b*. With such a configuration, the air having flown from the uncovered portion of the conveyance belt 325 not covered by the sheet P into the first upper chamber portion 341A1 also flows into the second upper chamber portion 341A2 through the ventilation holes 347*a* and is sucked out to the plurality of suction ports 345*a* and 345*b*. As a result, the negative pressure state in the first upper chamber portion 341A1 is increased between the portions of the flow path restrictor 347 not opposed to the suction ports 345*a* and 345*b* (for example, a portion opposed to a central region of the sheet P) and the back surface of the conveyance belt 325. As a result, even in the portions of the flow path restrictor 347 not opposed to the suction ports 345*a* and 345*b*, the attraction force for attracting the sheet P on the surface of the conveyance belt 325 can be obtained, thus allowing more stable conveyance performance.

Furthermore, in the present embodiment, the flow path restrictor 347 is disposed away from the back surface of the conveyance belt 325. Such a configuration can prevent the air-permeable structure of the conveyance belt 325 from being blocked by a wall surface portion (a portion of the divider in which no ventilation holes are formed) of the flow path restrictor 347. Therefore, even if the flow path restrictor 347 is disposed, the air hitting the surface of the conveyance belt 325 can pass through the surface of the conveyance belt 325 and come out to the back surface side of the conveyance belt 325. Therefore, the effect of suppressing the roll-up of the leading end of the sheet and the trailing end of the sheet as described above is maintained, and stable sheet conveyance performance is also maintained.

Figure 13:
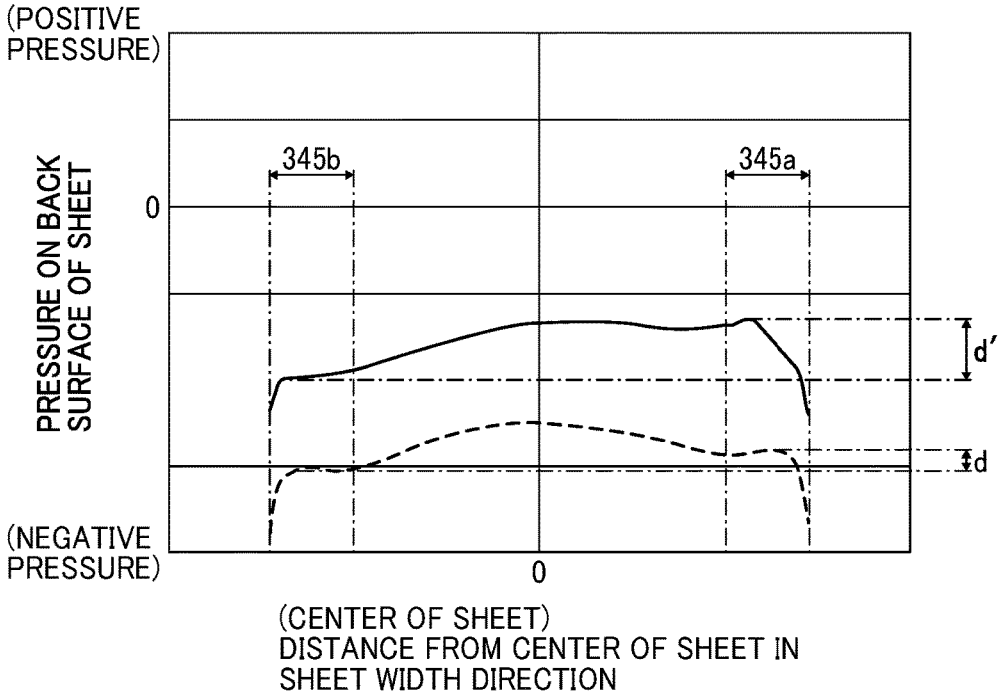
FIG. 13 is a graph of a distribution of pressure in a sheet width direction generated on the back surface of the sheet obtained when the suction assembly including the flow path restrictor and the suction assembly not including the flow path restrictor are used.

FIG. 13 is a graph of the distribution of pressure generated on the back surface of the sheet in the sheet width direction (hereinafter referred to as "sheet-width direction distribution") when the suction assembly 330 in the present embodiment including the flow path restrictor 347 and a suction assembly not including the flow path restrictor 347 are used. The graph is obtained by plotting the position in the sheet width direction (the distance from the center in the width direction of the sheet) as the abscissa and the pressure generated on the back surface of the sheet as the ordinate.

In the case of using the suction assembly without the flow path restrictor 347 as illustrated in FIG. 12, as indicated by the solid line in the graph of FIG. 13, the pressure difference (difference in suction force) between the sheet portions opposed to the suction ports 345*a* and 345*b* was d'. On the other hand, in the case of using the suction assembly 330 of the present embodiment including the flow path restrictor 347, as indicated by the broken line in the graph of FIG. 13, the pressure difference between the sheet portions opposed to the suction ports 345*a* and 345*b* (Difference in suction force) was d. As can be seen from FIG. 13, in the suction assembly 330 of the present embodiment, the pressure difference d between the sheet portions opposed to the suction ports 345*a* and 345*b* is smaller than the pressure difference d' of the suction assembly not including the flow path restrictor 347.

Further, according to the present embodiment, by providing the flow path restrictor 347, the flow path resistance from the portion of the conveyance belt 325 not blocked by the sheet P to the plurality of suction ports 345*a* and 345*b* is also increased. As a result, the amount of air flowing into the first upper chamber portion 341A1 decreases, and as a result, the negative pressure state inside the first upper chamber portion 341A1 is improved over the entire portion opposed to the sheet P. As a result, in the present embodiment, as illustrated in FIG. 13, the pressure (suction force) generated on the back surface of the sheet is increased by about 40% over the entire sheet P.

In the present embodiment, one flow path restrictor 347 is used. However, a plurality of stages of flow path restrictors 347 may be arranged in the flow path direction.

Further, in the present embodiment, the decompression chamber 342 as a decompression space located outside the in-belt space of the conveyance belt 325 is connected to the suction chamber 341 via the connection duct 343 from the lateral direction (substantially parallel to the back surface of the conveyance belt 325 and perpendicular to the sheet conveyance direction). Such a configuration allows a configuration in which the decompression chamber 342 and the suction device 350 connected to the decompression chamber 342 are not disposed within a limited space of the in-belt space of the conveyance belt 325.

Further, in the present embodiment, as illustrated in FIG. 9, the connection duct 343 is open to the suction chamber 341 over a conveyance direction range L in which the plurality of suction ports 345*a* and 345*b* are open. Such a configuration can reduce suction unevenness in the sheet conveyance direction as compared with the case where the connection duct 343 is open to the suction chamber 341 only in a part of the conveyance direction range L in which the suction ports 345*a* and 345*b* are open. Particularly, as in the present embodiment, it is preferable to set a conveyance direction range in which the connection duct 343 is open to the suction chamber 341 and the conveyance direction range L in which the plurality of suction ports 345*a* and 345*b* are open to substantially the same range.

Table 1 below represents a result of an experimental example of examining the relationship between the height of the first upper chamber portion 341A1 (the distance between the back surface of the conveyance belt 325 and the upper surface of the flow path restrictor 347) and the fluttering (roll-up) of the sheet P in the present embodiment. In this experimental example, the fluttering level was observed when the height of the first upper chamber portion 341A1 was 0 mm, 10 mm, and 20 mm. A case where the fluttering level was large and exceeded the allowable range was denoted by "poor", the case where the fluttering level was small and within the allowable range was denoted by "fair", and the case where there was no fluttering was denoted by "good". According to this experimental example, it was confirmed that fluttering can be suppressed if the height of the first upper chamber portion 341A1 is 10 mm or more.

TABLE 1

| | Height of First Upper Chamber Portion 341A | | |
|---|---|---|---|
| | 0 mm | 10 mm | 20 mm |
| Sheet Fluttering Level | Poor | Good | Good |

According to this experimental example, in order to suppress fluttering of the sheet, the height of the first upper chamber portion 341A1 of the suction chamber 341 is not set to zero, that is, the back surface of the conveyance belt 325 is preferably separate from the upper surface of the flow path restrictor 347. Hence, in the present embodiment, it is avoided that the conveyance belt 325 is bent by the suction force from the ventilation holes 347*a* of the flow path restrictor 347 and the back surface of the conveyance belt 325 is brought into close contact with the upper surface of the flow path restrictor 347. In order to prevent the height of the first upper chamber part 341A1 from becoming zero, as illustrated in FIG. 9 and FIG. 10, belt support rods 349 as a belt support are disposed to support a sheet conveyance portion (a belt portion bearing the sheet) of the conveyance belt 325 from the back side of the conveyance belt 325.

In the present embodiment, the plurality of belt support rods 349 extending in the sheet conveyance direction are tensioned and arranged in the sheet width direction. Note that there is no particular limitation on how the belt support rods 349 are tensioned. Further, the lower supporter is not limited to a rod-shaped member, such as the belt support rod 349, but may be, for example, a belt support, such as a mesh member, as long as the supporter does not hamper the suction.

Figure 14:
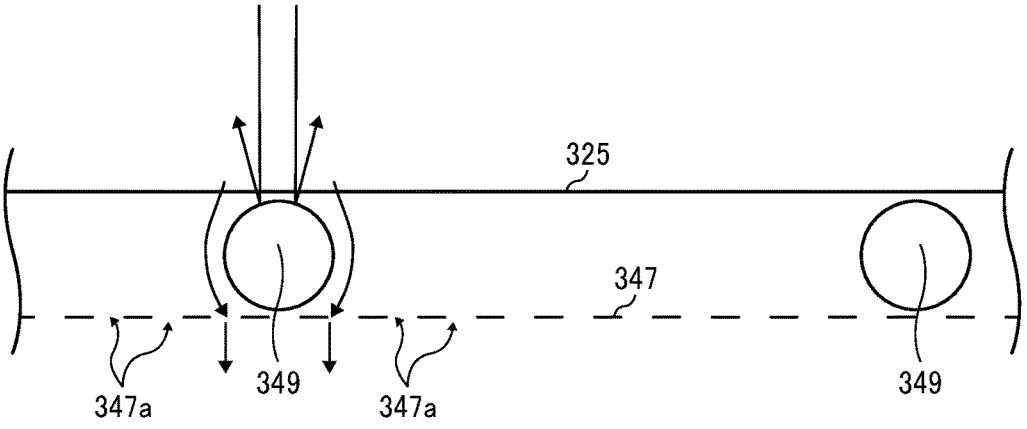
FIG. 14 is an illustration of air flow in a configuration in which a belt support rod is sandwiched between the back surface of the conveyance belt and an upper surface of the flow path restrictor.

However, as illustrated in FIG. 14, when the belt support rods 349 are configured to be sandwiched between the back surface of the conveyance belt 325 and the upper surface of the flow path restrictor 347, air flow passing around the belt support rod 349 cannot pass through the ventilation holes 347*a* located on the lower side of the belt support rods 349. Accordingly, as illustrated in FIG. 14, air flow from the blower fan 311 hitting the belt support rod 349 is unlikely to pass through lateral sides of the belt support rod 349, thus reducing the effect of suppressing fluttering (roll-up) of the sheet P.

Figure 15:
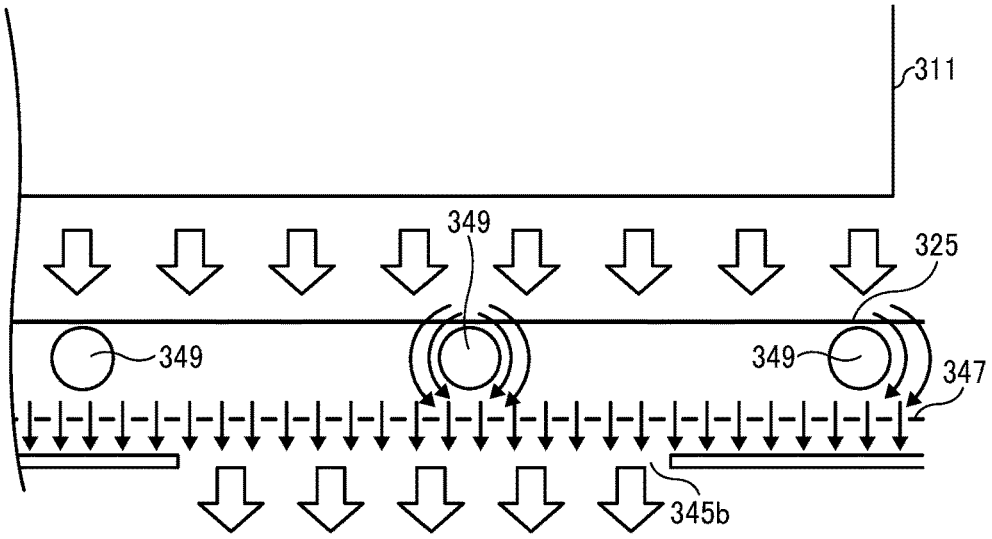
FIG. 15 is an illustration of air flow in a configuration in which the belt support rod is separated from the upper surface of the flow path restrictor.

Therefore, as illustrated in FIG. 15, it is preferable that the belt support rods 349 are disposed away from the upper surface of the flow path restrictor 347. With this configuration, air flow passing around the belt support rod 349 can pass through the ventilation holes 347*a* located on the lower side of the belt support rod 349. As a result, as illustrated in FIG. 15, the air flow from the blower fan 311 hitting the belt support rod 349 easily passes through the side of the belt support rod 349, thus preventing a reduction in the effect of suppressing the fluttering (roll-up) of the sheet P.

Table 2 (consisting of Table 2-1 and Table 2-2) below represents a result of an experimental example examining the influence of the relationship between the wind speed [m/s] of the blower fan 311 and the suction amount [$m^3$/min] of the suction device 350 on the fluttering level of the sheet in the present embodiment. The suction amount of the suction device 350 is smaller in the order of A, B, C and D.

As illustrated in the following Table 2, it can be confirmed that the sheet fluttering level greatly changes according to the relationship between the wind speed of the blower fan 311 and the suction amount of the suction device 350.

TABLE 2

| | | Air Speed of Blower Fan [m/s] | | | | | |
|---|---|---|---|---|---|---|---|
| | | Low | | | Moderate | | |
| | | Individual Evaluation | | Total Evaluation | Individual Evaluation | | Total Evaluation |
| Suction Amount [$m^3$/min] | A | Leading End | Good | Good | Leading End | Good | Good |
| | | Center | Good | | Center | Good | |
| | | Trailing End | Good | | Trailing End | Good | |
| | B | Leading End | Good | Fair | Leading End | Good | Fair |
| | | Center | Fair | | Center | Fair | |
| | | Trailing End | Good | | Trailing End | Good | |
| | C | Leading End | Good | Fair | Leading End | Good | Poor |
| | | Center | Fair | | Center | Fair | |
| | | Trailing End | Fair | | Trailing End | Poor | |
| | D | Leading End | Fair | Poor | Leading End | Fair | Poor |
| | | Center | Fair | | Center | Poor | |
| | | Trailing End | Poor | | Trailing End | Poor | |

| | | Air Speed of Blower Fan [m/s] Large | | |
|---|---|---|---|---|
| | | Individual Evaluation | | Total Evaluation |
| Suction Amount [$m^3$/min] | A | Leading End | Good | Fair |
| | | Center | Fair | |
| | | Trailing End | Good | |
| | B | Leading End | Fair | Poor |
| | | Center | Fair | |
| | | Trailing End | Poor | |
| | C | Leading End | Fair | Poor |
| | | Center | Fair | |
| | | Trailing End | Poor | |
| | D | Leading End | Poor | Poor |
| | | Center | — | (Not conveyed) |
| | | Trailing End | — | |

According to the above two experimental examples, the fluttering of the sheet can be suppressed by appropriately adjusting the wind speed of the blower fan 311, the suction amount of the suction device 350, and the height of the first upper chamber portion 341A1.

Variation 1

Next, a variation of the suction assembly 330 in the present embodiment (hereinafter, referred to as "Variation 1") is described below. In the embodiment described above, the connection duct 343 is connected to the suction chamber 341 located in the in-belt space of the conveyance belt 325 from the lateral direction, to suck the inside of the suction chamber 341 from the lateral direction. On the other hand, in Variation 1, the decompression chamber 342 as a decompression space sucked by the suction device 350 is connected, via the connection duct 343 as a connection passage, to the suction chamber 341' as a suction passage from the substantially normal direction to the back surface of the belt portion in the conveyance belt 325 to bear the sheet. Since the basic configuration of the suction assembly 330' in Variation 1 is substantially the same as that of the suction assembly 330 in the above-described embodiment, the differences from the above-described embodiment are mainly described below.

Figure 16:
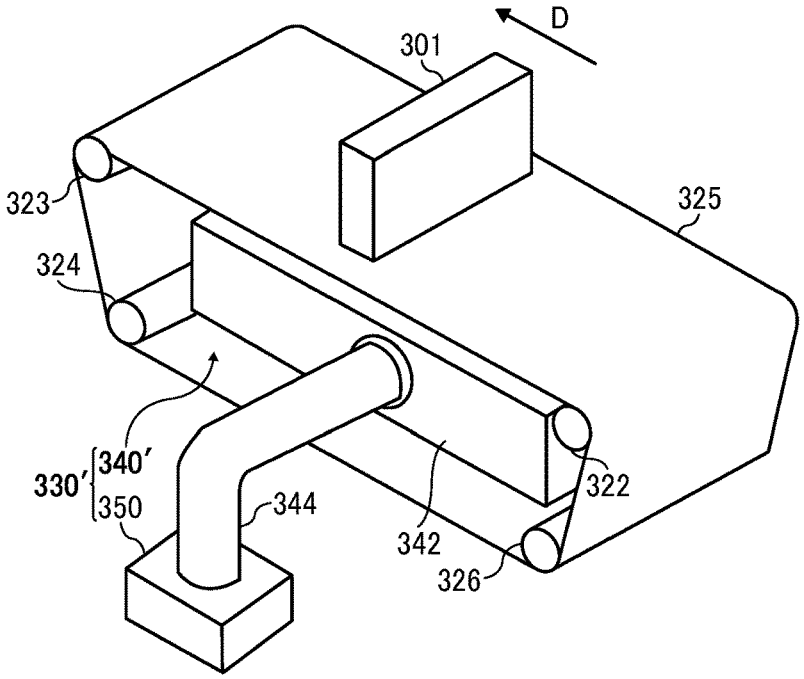
FIG. 16 is a perspective view of a configuration of the drying unit employing the suction assembly in Variation 1.
Figure 17:
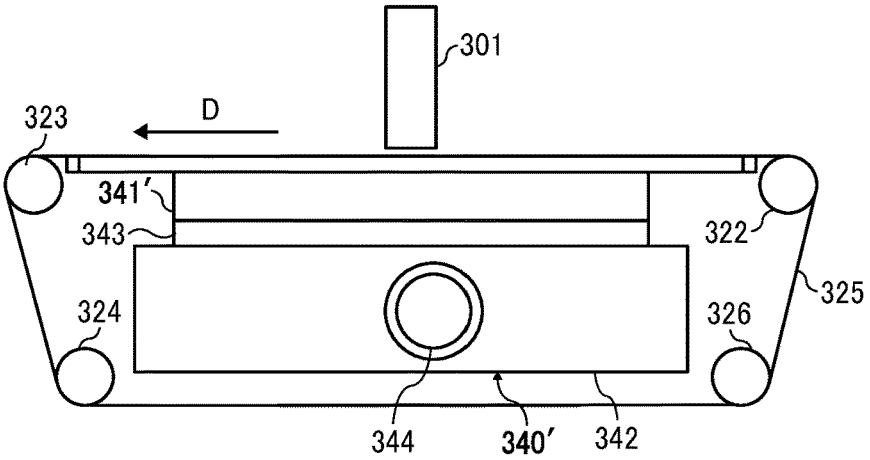
FIG. 17 is an illustration of the drying unit as seen from a lateral direction.
Figure 18:
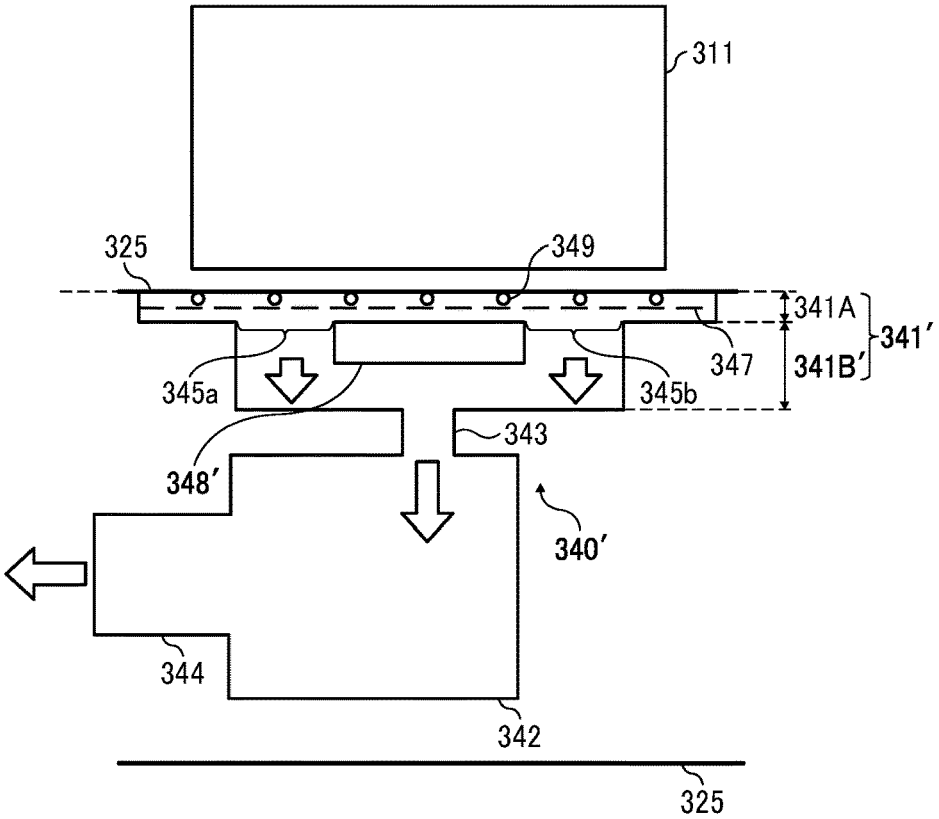
FIG. 18 is a cross-sectional view of an internal structure of a suction chamber in the suction assembly of the drying unit.

FIG. 16 is a perspective view of a configuration of the drying unit 300 employing the suction assembly 330 in Variation 1. FIG. 17 is an illustration of the drying unit 300 according to Variation 1 as seen from the lateral direction (the direction substantially parallel to the back surface of the conveyance belt 325 and orthogonal to the sheet conveyance direction). FIG. 18 is a cross-sectional view of an internal structure of the suction chamber 340' in the suction assembly 330' of Variation 1.

The suction assembly 330' of Variation 1 includes a suction chamber 341', the decompression chamber 342, and the connection duct 343 in the in-belt space surrounded by the inner circumferential surface (back surface) of the conveyance belt 325. The connection duct 343 communicates the suction chamber 341' with the decompression chamber 342. In Variation 1, the suction device 350 disposed outside the in-belt space of the conveyance belt 325 sucks the inside of the decompression chamber 342 located in the in-belt space, via the suction duct 344. As a result, the inside of the decompression chamber 342 is brought into a negative pressure state, and the inside of the suction chamber 341' is sucked via the connection duct 343 by the negative pressure in the decompression chamber 342.

In the present Variation 1, as illustrated in FIG. 18, the connection duct 343 is open to the suction chamber 341' at a position not opposed to the plurality of suction ports 345*a* and 345*b* in the suction chamber 341'. Such a configuration can reduce the difference in suction capability between the suction ports 345*a* and 345*b*, as compared with the case where the connection duct 343 is open at a position opposed to any one of the suction ports 345*a* and 345*b*. In particular, the configuration in which the connection duct 343 is open at an intermediate position between the positions opposed to the suction ports 345*a* and 345*b* as in the present Variation 1 can further reduce the difference in suction capability between the suction ports 345*a* and 345*b*. In addition, in the present Variation 1, as in the above-described embodiment, the partition 348' partitions the suction flow paths from the plurality of suction ports 345*a* and 345*b* to the common connection duct 343. Such a configuration can adjust the flow-path sectional area (sectional area orthogonal to the flow path direction) of each of the partitioned suction flow paths can be adjusted, thus further reducing the difference in suction capability between the suction port 345*a* and the suction port 345*b*.

However, even with such a configuration, it may be difficult to finely adjust the difference in suction capability between the suction port 345*a* and the suction port 345*b*, and it may be difficult to stably adjust the difference in suction capability within an allowable range. Therefore, in the portion of the conveyance belt 325 to which any one of the suction ports 345*a* and 345*b* is opposed, the attraction force for attracting the sheet P is likely to be insufficient. Such an insufficient attraction force is likely to cause a conveyance failure, such as roll-up of the sheet at an end portion borne on a portion of the conveyance belt 325 opposed to one of the suction ports 345*a* and 345*b* having a relatively low suction capability.

As illustrated in FIG. 18, in the present Variation 1, between the plurality of suction ports 345*a* and 345*b* in the upper chamber portion 341A and the back surface of the conveyance belt 325, the flow path restrictor 347 as the divider is disposed that includes one or plurality of ventilation holes 347*a*, having a smaller opening area than the suction ports 345*a* and 345*b*, at a portion opposed to each of the suction ports 345*a* and 345*b*. With such a configuration, as in the above-described embodiment, the bias of the attraction force for attracting the sheet P on the conveyance belt 325 can be reduced, thus enhancing the conveyance performance of the sheet P.

In the present Variation 1, the decompression chamber 342 is disposed in the in-belt space of the conveyance belt 325. Note that the decompression chamber 342 can be disposed outside of the in-belt space of the conveyance belt 325 by, for example, drawing the connection duct 343 to the outside of the in-belt space of the conveyance belt 325.

Variation 2

Next, another variation (hereinafter "Variation 2") of the suction assembly 330 in the present embodiment is described below. In the above-described embodiment and Variation 1, the suction device 350 is disposed outside the in-belt space of the conveyance belt 325. In contrast, in the present Variation 2, the configuration is employed in which the suction device 350' is disposed in the in-belt space of the conveyance belt 325. Since the basic configuration of the suction assembly 330" in the present Variation 2 is the same as that of the suction assembly 330 in the above-described embodiment, the following description mainly focuses on points different from the above-described embodiment.

Figure 19:
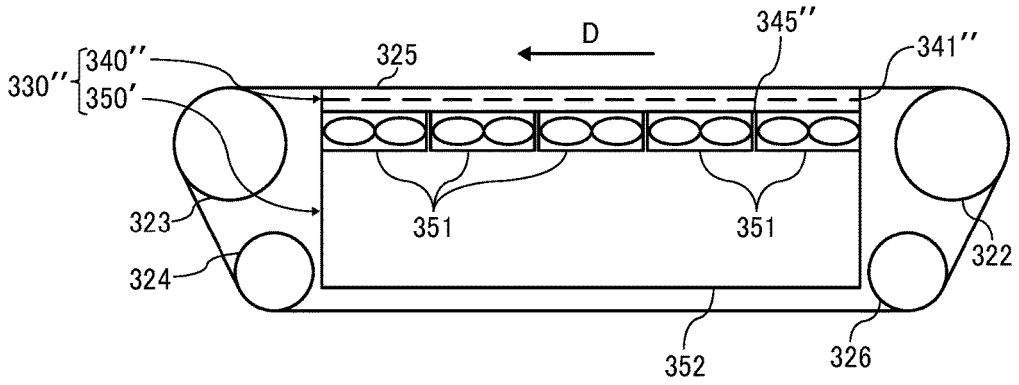
FIG. 19 is a cross-sectional view of the suction assembly in Variation 2 obtained when the suction chamber is cut along the sheet conveyance direction.
Figure 20:
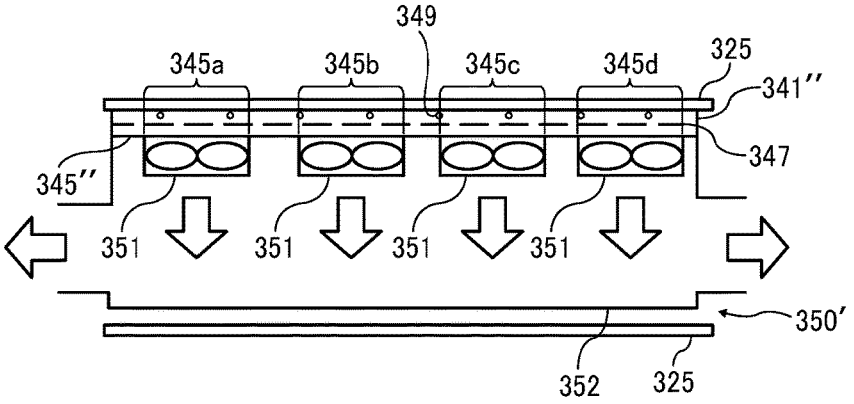
FIG. 20 is a cross-sectional view of the suction assembly in Variation 2 obtained when the suction chamber is cut along a cross section orthogonal to the sheet conveyance direction.

FIG. 19 is a cross-sectional view of the suction assembly 330" according to the present Variation 2 obtained when the suction chamber 340" is cut along the sheet conveyance direction. FIG. 20 is a cross-sectional view of the suction assembly 330" according to the present Variation 2 obtained when the suction chamber 340" is cut along a cross section orthogonal to the sheet conveyance direction.

The suction assembly 330" of the present Variation 2 includes the suction chamber 341" and axial flow fans 351 in the in-belt space surrounded by the inner circumferential surface (back surface) of the conveyance belt 325. The axial flow fans 351 serve as suction unit to suck the suction chamber 341". The suction chamber 341" of the present Variation 2 is formed between the suction port plate 345" and the back surface of the conveyance belt 325. The axial flow fans 351 are attached to the plurality of suction ports 345*a*, 345*b*, 345*c*, and 345*d*, respectively, formed in the suction chamber 341". In the present Variation 2, the inside of the suction chamber 341" is sucked from the plurality of suction ports 345*a*, 345*b*, 345*c*, and 345*d* by the plurality of axial flow fans 351. Air (gas) sucked from the suction ports 345*a*, 345*b*, 345*c* and 345*d* is exhausted through the exhaust duct 352. Note that the exhaust duct 352 is not necessarily provided.

In such a configuration, it may be difficult to finely adjust the difference in the suction capability between the suction ports 345*a* to 345*d* due to, e.g., individual differences among the plurality of axial flow fans 351 or differences in flow resistance on the exhaust side. It may also be difficult to stably adjust the difference within an allowable range. Therefore, in the portion of the conveyance belt 325 to which any one of the suction ports 345*a* to 345*d* is opposed, the attraction force for attracting the sheet P is likely to be insufficient. Such an insufficient attraction force is likely to cause a conveyance failure, such as roll-up of the sheet at an end portion borne on a portion of the conveyance belt 325 opposed to one of the suction ports 345*a* and 345*b* having a relatively low suction capability.

In the present Variation 2, as illustrated in FIGS. 19 and 20, between the plurality of suction ports 345*a* to 345*d* in the suction chamber 341" and the back surface of the conveyance belt 325, the flow path restrictor 347 as the divider is disposed that includes one or a plurality of ventilation holes 347*a*, having a smaller opening area than each of the suction ports 345*a* to 345*d*, at a portion opposed to each of the suction ports 345*a* to 345*d*. With such a configuration, as in the above-described embodiment, the bias of the attraction force for attracting the sheet P on the conveyance belt 325 can be reduced, thus enhancing the conveyance performance of the sheet P.

Variation 3

Figure 21:
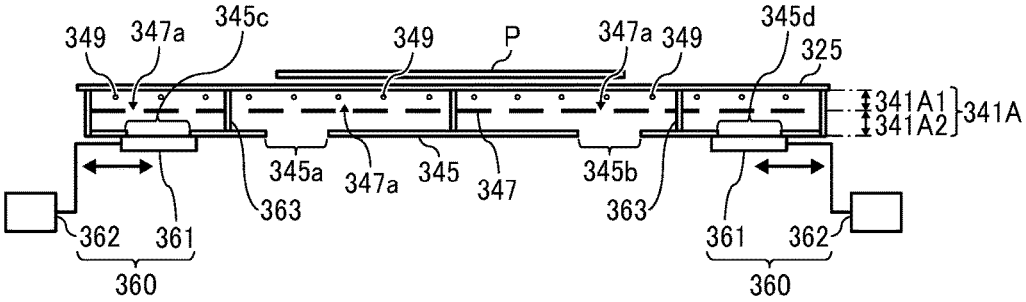
FIG. 21 is a cross-sectional view of the suction assembly in Variation 3 obtained when the suction chamber of the suction assembly in Variation 3 is cut along a cross section orthogonal to the sheet conveyance direction.

Next, still another variation (hereinafter, "Variation 3") of the suction assembly 330 in the present embodiment is described below. FIG. 21 is a cross-sectional view of the suction assembly 330 according to the present Variation 3 obtained when the suction chamber 340 is cut along a cross section orthogonal to the sheet conveyance direction. Since the basic structure of the suction assembly 330 in the present Variation 3 is the same as that of the suction assembly 330 in the above-described embodiment, differences from the above-described embodiment are mainly described below.

The suction assembly 330 according to the present Variation 3 has a configuration in which four suction ports 345*a* to 345*d* are arranged side by side in the sheet width direction. In the case in which the sheet P as a conveyed object has a small width, as illustrated in FIG. 21, the two suction ports 345*c* and 345*d* located on end portions in the sheet width direction do not substantially contribute to the attraction effect for attracting the sheet P on the surface of the conveyance belt 325.

Hence, in the present Variation 3, the suction device 350 includes an opening-and-closing mechanism 360 as a switcher. With respect to the two suction ports 345*c* and 345*d* on the end portion side in the sheet width direction, the opening-and-closing mechanism 360 switches a suctionable state in which the suction device 350 can suck the inside of the upper chamber portion 341A via the suction ports 345*c* and 345*d* and an unsuctionable state in which the suction device 350 cannot suck the inside of the upper chamber portion 341A via the suction ports 345*c* and 345*d*. The opening-and-closing mechanism 360 of the present Variation 3 includes a lid 361 and a driving unit 362. The lid 361 switches the suction ports 345*c* and 345*d* between an open state (suctionable state) and a closed state (unsuctionable state). The driving unit 362 slides the lid 361 on the surface of the suction port plate 345. Note that there is no particular limitation on the configuration of the switcher to switch between the suctionable state and the unsuctionable state.

According to the present Variation 3, as illustrated in FIG. 21, when the sheet P has a small width, the two suction ports 345*c* and 345*d* on the end sides in the sheet width direction can be turned into the closed state (unsuctionable state) by the opening-and-closing mechanism 360. Such a configuration can prevent air from being sucked from the suction ports 345*c* and 345*d* via the conveyance belt 325 and suppress a reduction in suction capability of the two suction ports 345*a* and 345*b* on the center side in the sheet width direction, which contribute to the effect of attracting the sheet P on the surface of the conveyance belt 325.

On the other hand, according to the present Variation 3, when the sheet P has a large width, the two suction ports 345*c* and 345*d* on the end sides in the sheet width direction can be turned into the open state (suctionable state) by the opening-and-closing mechanism 360. With such a configuration, the sheet P can be attracted to the surface of the conveyance belt 325 entirely in the sheet width direction by using not only the suction force from the two suction ports 345*a* and 345*b* on the center side in the sheet width direction but also the suction force from the two suction ports 345*c* and 345*d* on the end sides in the sheet width direction. Thus, conveyance performance can be stably obtained in conveying the sheet P having a large width.

In the present Variation 3, the internal space of the upper chamber portion 341A is divided by separating walls 363 between the two suction ports 345*c* and 345*d* on the end sides in the sheet width direction and the two suction ports 345*a* and 345*b* on the center side in the sheet width direction that contribute to the effect of attracting the sheet P on the surface of the conveyance belt 325. Sucking from the two suction ports 345*a* and 345*b* on the center side in the sheet width direction can prevent inflow of air from the belt portions opposed to the two suction ports 345*c* and 345*d* on the end sides in the sheet width direction. Such a configuration can further suppress a reduction in suction capability of the two suction ports 345*a* and 345*b* on the center side in the sheet width direction.

In particular, in the present Variation 3, the internal space of the upper chamber portion 341A is divided into independent spaces for the respective suction ports. Such a configuration can prevent air from being sucked from a belt portion opposed to one suction port by the suction force of another suction port, thus allowing suction management for each suction port. Therefore, the suction port to be used can be finely selected according to the sheet size or the type of sheet (such as a type requiring strong attractive force or a type not requiring strong attractive force) to obtain proper attraction force and conveyance performance.

Figure 22:
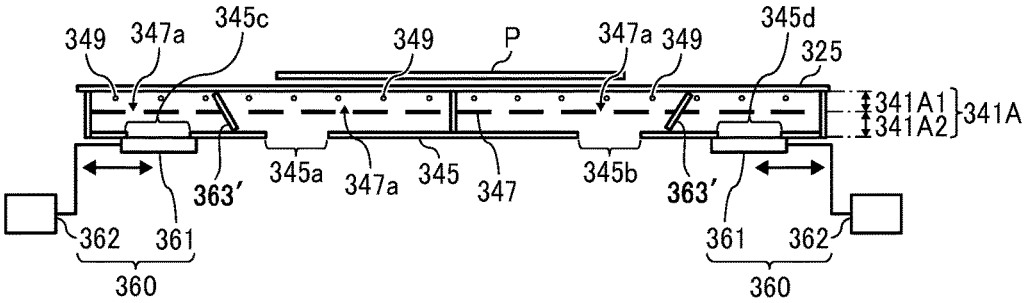
FIG. 22 is an illustration of an example in which a wall surface of a separating wall dividing an internal space of an upper chamber portion is inclined in the suction assembly.

In the present Variation 3, it is preferable to provide a flow guide to guide air (gas), which flows into the upper chamber portion 341A through the conveyance belt 325, toward the suction ports 345*a* to 345*d*. Specifically, for example, as illustrated in FIG. 22, the wall surfaces of the separating walls 363' dividing the internal space of the upper chamber portion 341A are inclined. Accordingly, air (gas) flowing into the upper chamber portion 341A through the conveyance belt 325 more easily flows toward the suction ports 345*a* and 345*b*. With such a configuration, turbulence of an air flow caused by air flowing into the upper chamber portion 341A after passing through the conveyance belt 325 is unlikely to occur inside the upper chamber portion 341A, thus allowing more stable suction force to be exerted. Such a flow guide is not limited to the present Variation 3, and may be adopted in the above-described embodiment and other variations.

Variation 4

Figure 23:
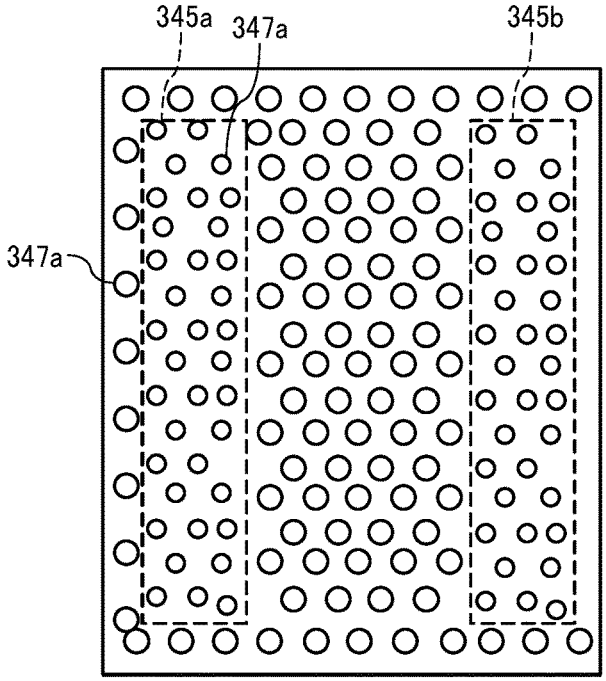
FIG. 23 is a plan view of a configuration example of ventilation holes in the suction assembly of Variation 4.

Next, still another variation (hereinafter, "Variation 4") of the suction assembly 330 in the present embodiment is described below. FIG. 23 is a plan view of a configuration example of the ventilation hole 347*a* in the suction assembly 330 of the present Variation 4. Since the basic configuration of the suction assembly 330 in the present Variation 4 is the same as that of the suction assembly 330 in the above-described embodiment, differences from the above-described embodiment are mainly described below.

In the suction assembly 330 of the present Variation 4, the opening ratio of the ventilation holes 347*a* in regions of the flow path restrictor 347 opposed to the suction ports 345*a* and 345*b* is smaller than the opening ratio of the ventilation holes 347*a* in a region of the flow path restrictor 347 not opposed to the suction ports 345*a* and 345*b*. Here, the opening ratio is the opening area of the ventilation holes 347*a* per unit area. In the present Variation 4, specifically, as illustrated in FIG. 23, the opening area of each ventilation hole 347*a* in portions of the flow path restrictor 347 opposed to the suction ports 345*a* and 345*b* is set smaller than the opening area of each ventilation hole 347*a* in a portion of the flow path restrictor 347 not opposed to the suction ports 345*a* and 345*b*.

According to the present Variation 4, the suction force acting on the suction ports 345*a* and 345*b* acts on the portion of the flow path restrictor 347 not opposed to the suction ports 345*a* and 345*b*, thus allowing the sheet P to be attracted over a wider range on the conveyance belt 325.

Figure 24:
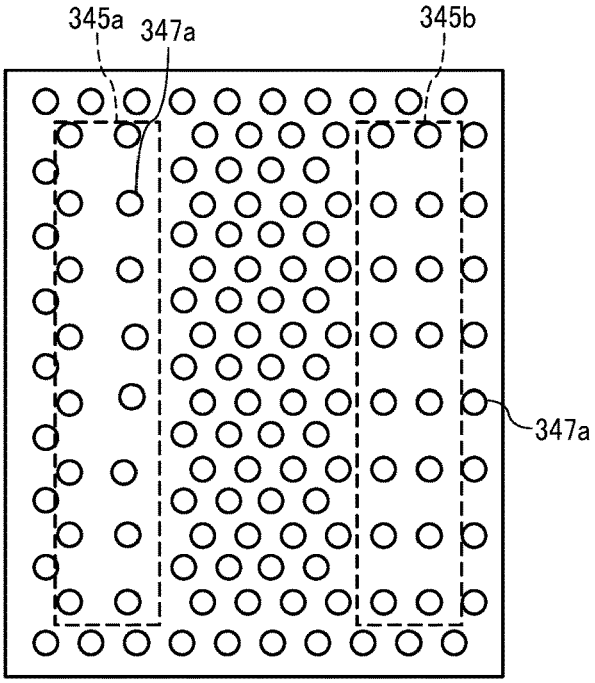
FIG. 24 is a plan view of another configuration example of the ventilation holes in the suction assembly of Variation 4.

The configuration in which the opening ratio of the ventilation hole 347*a* in the regions of the flow path restrictor 347 opposed to the suction ports 345*a* and 345*b* is set to be smaller than the opening ratio of the ventilation hole 347*a* in the region of the flow path restrictor 347 not opposed to the suction ports 345*a* and 345*b* is not limited to the configuration of the present Variation 3. For example, as illustrated in FIG. 24, the number of the ventilation holes 347*a* in the portions of the flow path restrictor 347 opposed to the suction ports 345*a* and 345*b* may be set to be smaller than the number of ventilation holes 347*a* in the portion of the flow path restrictor 347 not opposed to the suction ports 345*a* and 345*b*.

Variation 5

Figure 25:
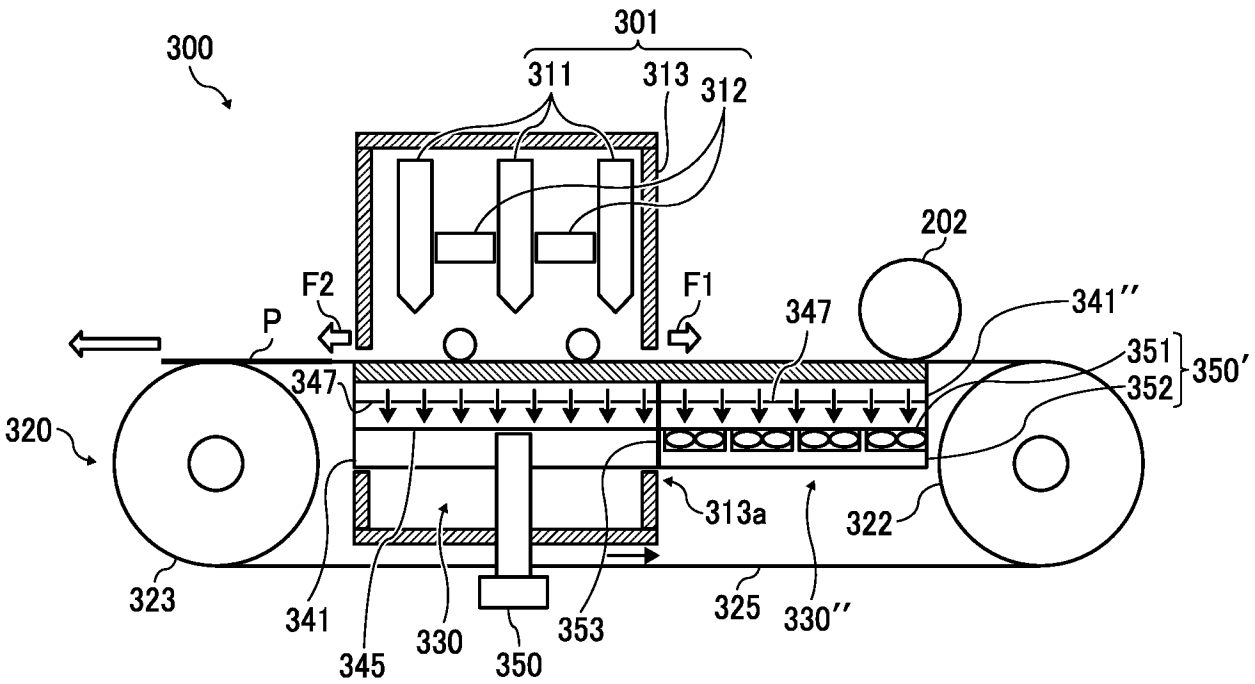
FIG. 25 is a front view of the drying unit in Variation 5.

Next, one variation (hereinafter, "Variation 5") of the conveyor 302 in the present embodiment is described below. FIG. 25 is a front view of the drying unit 300 in the present Variation 5. Since the basic structure of the drying unit 300 in the present Variation 5 is the same as that of the drying unit 300 in the above-described embodiment, differences from the above-described embodiment are mainly described below.

In the drying unit 300 in the present Variation 5, the configuration of the conveyance assembly disposed in the drying chamber 313 and the configuration of the conveyance assembly disposed outside the drying chamber 313 are different from each other. More specifically, in the configuration of the conveyance assembly disposed in the drying chamber 313, the suction assembly is the suction assembly 330 of the above-described embodiment and the suction device 350 is disposed outside the in-belt space of the conveyance belt 325. On the other hand, in the configuration of the conveyance assembly disposed outside the drying chamber 313, more specifically, on the upstream side from the drying chamber 313 in the sheet conveyance direction, the suction assembly is the suction assembly 330" of the above-described Variation 2 and the suction device 350' is disposed in the in-belt space of the conveyance belt 325.

In the present Variation 5, a partition wall 353 is disposed between the suction assembly 330 in the drying chamber 313 and the suction assembly 330" outside the drying chamber 313. The partition wall 353 is constituted by a side wall of the suction assembly 330 disposed in the drying chamber 313. Note that the partition wall 353 has a configuration in which the suction assembly 330 disposed in the drying chamber 313 and the suction assembly 330" disposed outside the drying chamber 313 may be constituted by a single housing including the partition wall.

Variation 6

Next, another variation (hereinafter, "Variation 6") of the conveyor 302 in the present embodiment is described. In the above-described embodiment and Variations 1 to 5, the supporter is constituted by the conveyance belt 325 which is an endless belt, and the sheet P attracted on the surface of the conveyance belt 325 is conveyed with the movement of the surface of the conveyance belt 325. On the other hand, in the present Variation 6, a platen 327 having an air-permeable structure constitutes the supporter. In a state in which the sheet P is attracted on the surface of the platen 327 by a sheet conveyance assembly 328 different from the supporter, the sheet P is slid and conveyed along the surface of the platen 327.

Since the configuration of the suction assembly 330 in the present Variation 6 is substantially the same as that in the above-described embodiment, in the following description, the sheet conveyance assembly 328 used instead of the belt conveyance assembly 320 in the above-described embodiment is mainly described.

Figure 26:
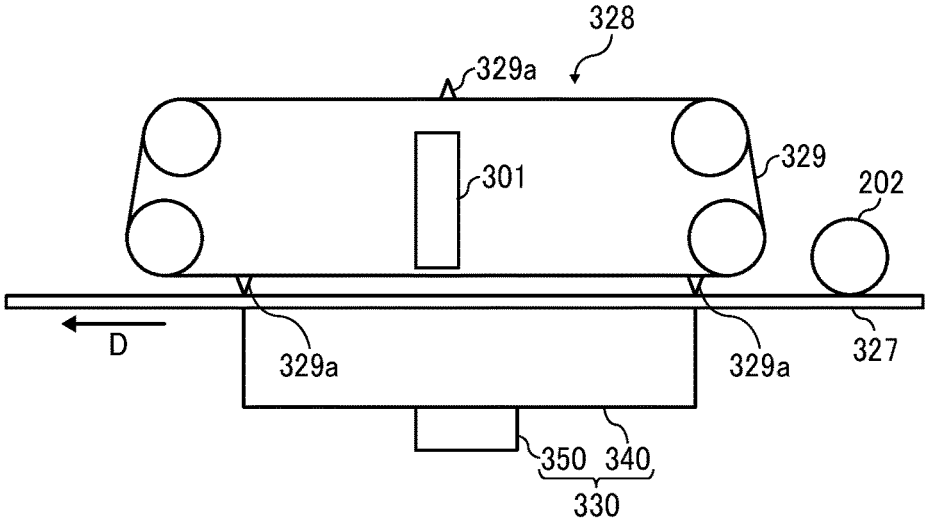
FIG. 26 is an illustration of a sheet conveyance assembly in Variation 6.

FIG. 26 is an illustration of the sheet conveyance assembly 328 in the present Variation 6. The suction assembly 330 of the present Variation 6 has substantially the same configuration as the above-described embodiment except that, instead of the conveyance belt 325 disposed to cover the upper portion of the suction chamber 340, the platen 327 having the air-permeable structure in the present Variation 6 is disposed to cover the upper portion of the suction chamber 340.

Above the platen 327, the sheet conveyance assembly 328 including a moving belt 329 formed of an endless belt is disposed. Claw portions 329*a* to hold a leading end of the sheet P are attached to an outer circumferential surface of the moving belt 329. An upstream portion of the platen 327 in the sheet conveyance direction is opposed to the transfer cylinder 202 of the image forming unit 200. The sheet P conveyed by the transfer cylinder 202 is sent onto the platen 327 in such a manner that the back surface of the image surface faces the surface of the platen 327 and the leading end of the sheet P is held by one claw portion 329*a* of the moving belt 329 in the sheet conveyance assembly 328. Thereafter, the claw portion 329*a* moves along the surface of the platen 327 as the moving belt 329 moves, so that the sheet P held by the claw portion 329*a* also moves along the surface of the platen 327. At this time, as the inside of the suction chamber 340 is brought into a negative pressure state by suction of the suction device 350, the back surface of the sheet P is attracted to the surface of the platen 327. In such a state, the sheet P is conveyed so as to slide on the surface of the platen 327.

Variation 7

Next, still another variation (hereinafter, "Variation 7") of the drying unit 300 in the present embodiment is described. In the above-described embodiment and Variations 1 to 6 are described the examples of the drying unit 300 that dries the sheet P after an image is formed by discharging ink. In the drying unit 300 according to the present Variation 7, the above-described pre-processing unit provides a predetermined treatment liquid 501 to the sheet P by, e.g., application or coating. The drying unit 300 dries the sheet P, to which the treatment liquid 501 has been provided, before the image is formed by discharging ink from the image forming unit 200.

Note that the basic configuration of the present Variation 7 is the same as that of the inkjet recording apparatus 1 according to the above-described embodiment except that the pre-processing unit and the drying unit 300 are added between the sheet feeding unit 100 and the image forming unit 200. The basic configuration of the added drying unit 300 is also the same as in the above-described embodiment. Therefore, differences from the above-described embodiment are mainly described below.

Figure 27:
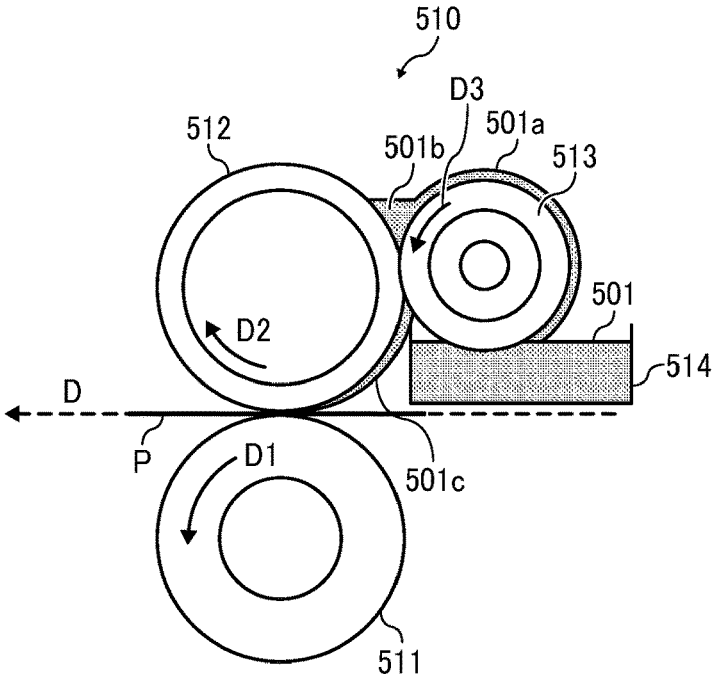
FIG. 27 is an illustration of a part of an application device as a pre-processing unit in Variation 7.

FIG. 27 is an illustration of a main part of an application device 510 as a pre-processing unit used in the present Variation 7. The pre-processing unit of the present Variation 7 includes the application device 510 that applies a treatment liquid 501 to a sheet P fed from the sheet feeding unit 100. Examples of the treatment liquid 501 include a modifying material that is applied to and modifies the surface of the sheet P. One example of the modifying material is a fixing agent (setting agent). The fixing agent is preliminarily applied uniformly on the sheet P to promptly permeate the moisture of the ink into the sheet P, thicken the color component, and also speed up the drying. Thus, the fixing agent can prevent bleeding (or feathering) or strike-through and increase productivity (the number of images output per unit time).

Compositionally, the treatment liquid 501 is preferably a solution containing, for example, a surfactant (any one or a mixture of two or more of an anionic type, a cationic type and a nonionic and type), celluloses (hydroxypropyl cellulose or the like) to facilitate permeation of moisture, and a base, such as talc fine powder. The treatment liquid 501 may also contain fine particles.

The application device 510 of the present Variation 7 includes a conveyance roller 511 to convey the sheet P, an application roller 512 opposed to the conveyance roller 511 to apply the treatment liquid 501 to the sheet P, and a squeeze roller 513 to supply the treatment liquid 501 to the application roller 512 and thin a liquid film (a film of the treatment liquid 501). The directions of rotation of the conveyance roller 511, the application roller 512, and the squeeze roller 513 are indicated by arrows D1, D2, and D3, respectively, in FIG. 27. The application roller 512 is disposed in contact with the conveyance roller 511, and the squeeze roller 513 is disposed in contact with the application roller 512.

In the present Variation 7, when the treatment liquid 501 is applied to the sheet P by the application device 510, the squeeze roller 513 rotates in the direction of arrow D3 in FIG. 27. Accordingly, the treatment liquid 501 in a liquid tray 514 is scooped onto the surface of the squeeze roller 513, is conveyed by rotation of the squeeze roller 513 in the state of a liquid film layer 501*a*, and accumulated (as a treatment liquid 501*b*) in a valley portion (contact portion or nip portion) between the squeeze roller 513 and the application roller 512. Here, the squeeze roller 513 and the application roller 512 are in contact with each other at a constant pressing force. When the treatment liquid 501*b* accumulated in the valley portion passes between the squeeze roller 513 and the application roller 512, the treatment liquid 501*b* is squeezed by pressure. A liquid film layer 501*c* of the treatment liquid 501 is formed and is conveyed toward the conveyance roller 511 by the rotation of the application roller 512. The liquid film layer 501*c* transferred by the application roller 512 is applied to the sheet P.

The sheet P, on which the liquid film layer 501*c* of the treatment liquid 501 has been applied as described above, is conveyed to the drying unit 300 having substantially the same configuration as that of the drying unit 300 according to the above-described embodiment (including each of Variations 1 to 6). The sheet P subjected to the drying process by the drying unit 300 is fed to the image forming unit 200, and an image is formed by discharging ink in the image forming unit 200.

In the above description, the conveyed object is the sheet P as the sheet material. Note that the conveyed object is not limited to the sheet P or a sheet-shaped member.

The above-described embodiments are limited examples, and the present disclosure includes, for example, the following aspects having advantageous effects.

Aspect A

A conveying device, such as the drying unit 300, to convey a conveyed object, such as the sheet P, includes a supporter, such as the conveyance belt 325 or the platen 327, having a front surface to support the conveyed object, the supporter having an air-permeable structure; a blower, such as the blower fan 311, to blow air toward the front surface of the supporter; a negative pressure generator, such as the suction assembly 330, the suction assembly 330', or the suction assembly 330", including a suction unit, such as the suction device 350, the suction device 350', or the axial flow fan 351, to suck air from a space, such as the upper chamber portion 341A, at a back surface side of the supporter through a plurality of suction ports, such as the plurality of suction ports 345*a* to 345*d*, to create a negative pressure state in the space and attract the conveyed object onto the front surface of the supporter, the plurality of suction ports disposed away from and opposed to a back surface of the supporter; and a divider, such as the flow path restrictor 347, disposed away from the back surface of the supporter between the plurality of suction ports and the back surface of the supporter in the space, the divider having a plurality of ventilation holes, such as the plurality of ventilation holes 347*a*, smaller in opening area than each of the plurality of suction ports. When the conveyed object is smaller than the supporter, gas, such as air, flows into the negative pressure space from a portion of the supporter not covered by the conveyed object, and the gas flows into the plurality of suction ports, thus creating a less negative pressure state in the space than the case in which the conveyed object is so large to cover the entire surface of the supporter. Even in such a situation, a relatively high negative pressure state can be maintained in a portion of the negative pressure space close to the plurality of suction ports. Therefore, a sufficient attraction force for attracting the conveyed object can be generated in the portions of the supporter to which the plurality of suction ports are opposed. Even if the attraction force of the other portion of the supporter is insufficient, the conveyed object can be conveyed while being attracted on the supporter. However, when suction is performed by the suction unit from the plurality of suction ports that are open to the same negative pressure space, it may be difficult to equalize the flow channel resistance ahead of each suction port. Accordingly, it may be difficult to equalize the difference in flow path resistance between the flow paths on which the gas flowing from the portion of the supporter not covered by the conveyed object into the negative pressure space passes through the suction ports. It may be difficult to equalize the amount of gas that can be sucked per unit time (hereinafter referred to as "suction capability"). Accordingly, in a situation where the conveyed object is smaller than the supporter and gas flows from the portion of the supporter not covered by the conveyed object to the negative pressure space, the attraction force for attracting the conveyed object on the supporter is biased toward a portion of the supporter opposed to a suction port having a high suction capability. The attraction force of a portion of the supporter opposed to a suction port having a low suction capability becomes insufficient, thus reducing the conveyance performance. In the present aspect A, the gas flowing into the negative pressure space from the supporter portion not blocked by the conveyed object flows into the plurality of suction ports through the ventilation holes of the divider. In the present aspect A, one or a plurality of ventilation holes provided in each of the divider portions opposed to the suction ports have an opening area smaller than each of the suction ports. When the number of the ventilation holes is two or more, the total opening area of the ventilation holes is smaller than each of the suction ports. Accordingly, the flow path resistance of the flow path portion in which the air flowing into the negative pressure space from the supporter portion not covered by the conveyed object flows toward each suction port is increased, compared to the configuration without the divider. By increasing the flow path resistance of the flow path portion up to each suction port as described above, the ratio of the influence of the flow path resistance of each flow path portion leading from each suction port to the flow path resistance of the entire flow path can be relatively decreased. Accordingly, the ratio of the gas sucked from the suction port with a high suction capacity to the gas sucked from the suction port with a low suction capacity among the gas amount per unit time sucked by the suction unit changes, and the difference in suction capability between the suction ports can be reduced. As a result, the bias of the attraction force for attracting the conveyed object on the supporter can be reduced. In a configuration in which the plurality of suction ports being open to the same negative pressure space are sucked by the suction unit, the conveyance performance in conveying a conveyed body smaller than the supporter can be enhanced However, in the case where the blower to blow air toward the surface of the supporter is provided, before the conveyed object enters into the blowing region of the blower, wind from the blower hits on the surface of the supporter present in the blowing region. At this time, if the divider is disposed in contact with the back side of the supporter, a wall surface portion (a divider portion in which the ventilation holes are not formed) of the divider blocks the air-permeable structure of the supporter. Accordingly, the wind from the blower does not pass through the supporter, thus generating an air flow so as to travel along the surface of the supporter. The air flow might travel toward the leading end of the conveyed object, which enters the blowing region from the upstream side in the conveyance direction of the conveyed object, and roll up the leading end of the conveyed object, thus causing conveyance failure of the conveyed object. Further, if the air flow is directed to the downstream side in the conveyance direction of the conveyed object so as to travel along the surface of the supporter, the trailing end of the conveyed object that has passed through the blowing region, is rolled up, thus causing conveyance failure of the conveyed object. In the present aspect A, since the divider is disposed away from the back surface of the supporter, the wall surface portion of the divider does not block the air-permeable structure of the supporter. Thus, the wind from the blower can pass through the supporter and be drawn into a region of the negative pressure space between the back surface of the supporter and the divider. Accordingly, the momentum of the air flow traveling along the surface of the supporter can be reduced and the above-described roll-up of the conveyed object can be suppressed, thus suppressing the conveyance failure of the conveyed object due to the air flow.

Aspect B

In the above-described aspect A, the negative pressure generator sucks, with the suction unit, the inside of a suction passage, such as the lower chamber portion 341B or the lower chamber portion 341B', communicating with the space via the plurality of suction ports, to create the negative pressure state in the space. Such a configuration can install the suction unit at a place away from the plurality of suction ports, thus increasing the degree of freedom of layout.

Aspect C

In the above-described aspect B, the negative pressure generator sucks, with the suction unit, the inside of the suction passage from a lateral direction that is substantially parallel to the back surface of the supporter and orthogonal to a conveyance direction of the conveyed object. Such a configuration can adopt a layout in which the suction unit is not disposed at a position opposed to the back surface of the supporter.

Aspect D

In the above-described aspect C, the supporter is formed of an endless belt, such as the conveyance belt 325. A decompression space, such as the decompression chamber 342, which is disposed outside an in-belt space surrounded by a back surface of the endless belt and sucked by the suction unit, is connected to the suction passage from the lateral direction via a connection passage, such as the connection duct 343. The connection passage is open to the suction passage over a range in which the plurality of suction ports are open in the conveyance direction. Such a configuration can reduce suction unevenness in the conveyance direction of the conveyed object, as compared with the case where the connection passage are open in the suction passage only in a part of the range in which the plurality of suction ports are open in the conveyance direction.

Aspect E

In the above-described aspect B, the negative pressure generator is configured such that the decompression space, such as the decompression chamber 342, which is sucked by the suction unit, is connected to the suction passage through the connection passage, such as the connection duct 343, from a substantially normal direction of the back surface of the supporter. The connection passage is open to the suction passage at a position not opposed to the plurality of suction ports being open to the suction passage. Such a configuration can reduce the difference in suction capability between the suction ports, as compared with the case where the connection passage is open at a position opposed to any one of the suction ports.

Aspect F

In any one of the above-described aspects B to E, in the suction passage, a partition, such as the partition 348 or the partition 348' is disposed to partition a plurality of suction flow paths from the plurality of suction ports to the suction unit. Such a configuration can reduce the difference in flow resistance between the suction ports by adjusting the cross-sectional area of each of the partitioned suction flow paths, and the difference in suction capability between the suction ports is likely to be small.

Aspect G

In the above-described aspect B, the suction unit, such as the axial flow fan 351, is disposed in each of the plurality of suction ports. Such a configuration can adopt a layout in which the suction unit is disposed in each of the plurality of suction ports.

Aspect H

In any one of the above-described aspects A to G, the supporter includes an endless belt, such as the conveyance belt 325, and a belt support, such as the belt support rod 349, to support a conveyance portion of the endless belt, on which the conveyed object is attracted to be conveyed, from a back side of the endless belt. Such a configuration can maintain a separated state between the back surface of the supporter and the divider and obtain higher conveyance performance.

Aspect I

In any one of the above-described aspects A to H, the conveying device includes a conveyor, such as the sheet conveyance assembly 328, to convey the conveyed object such that the conveyed object relatively moves with respect to the surface of the supporter, such as the platen 327. Such a configuration can adopt a configuration in which the conveyed object is slid along the surface of the supporter in a state in which the conveyed object is attracted on the surface of the supporter.

Aspect J

In any one of the above-described aspects A to I, the conveying device includes a switcher, such as the opening-and-closing mechanism 360, to switch at least one suction port, such as the suction port 345*c* or 345*d*, of the plurality of suction ports, between a suctionable state, such as the open state, in which the inside of the space can be sucked by the suction unit via the at least one suction port and an unsuctionable state, such as the closed state, in which the inside of the space can not be sucked by the suction unit. With such a configuration, a suction port not substantially contributing to the effect of attracting the conveyed object to the surface of the supporter can be switched to the unsuctionable state, thus preventing suction from the non-contributing suction port and securing the suction capability of the other suction port.

Aspect K

In any one of the above-described aspects A to J, the conveying device includes a flow guide, such as the separating walls 363', to guide the gas, flowing into the space through the supporter, toward the suction port. Such a configuration can suppress disturbance of the air flow caused by the gas that has passed through the supporter and flowed into the space, thus allowing more stable suction force to be exerted.

Aspect L

In any one of the above-described aspects A to K, an opening ratio of ventilation holes in a region in which the divider is opposed to the suction ports is set to be smaller than the opening ratio of ventilation holes in a region in which the divider is not opposed to the suction ports. Such a configuration causes the suction force acting on each of the suction ports to act on a portion of the divider not opposed to the suction ports, thus allowing the conveyed object to be attracted to a wider range of the supporter.

Aspect M

A printing apparatus, such as the inkjet recording apparatus 1, includes a liquid discharge device, such as the liquid discharge heads 220C, 220M, 220Y, and 220K, to discharge liquid, such as ink, onto a conveyed object, such as sheet P; and the conveying device, such as the drying unit 300, according to any one of the above-described aspects A to L to convey the conveyed object. According to the aspect M, a printing apparatus having stable conveyance performance can be achieved.

Aspect N

In the above-described aspect M, the conveying device is disposed downstream from the liquid discharge device in the conveyance direction of the conveyed object. Such a configuration can obtain a stable conveyance performance in a printing apparatus that blows air to a conveyed object to which liquid has been attached.

Aspect O

In the above-described aspect M, the printing apparatus includes a pre-processing unit, such as the application device 510, disposed upstream from the liquid discharge device in the conveyance direction of the conveyed object, to apply a treatment liquid, such as the treatment liquid 501, to the conveyed object before the liquid is discharged onto the conveyed object by the liquid discharge device. The conveying device is disposed upstream from the liquid discharge device and downstream from the pre-processing unit in the conveyance direction of the conveyed object. Such a configuration can obtain stable conveying performance in a printing apparatus that blows air to a conveyed object to which a treatment liquid has been attached.

Aspect P

A drying device includes the conveying device according to any one of the aspects A to L. The blower applies wind to the conveyed object to dry the conveyed object. According to the aspect P, stable conveying performance can be obtained in a drying device that dries a conveyed object.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A conveying device to convey a conveyed object, the conveying device comprising:

a conveyance belt having a front surface to support the conveyed object, the conveyance belt having an air-permeable structure;

a suction chamber disposed in a space surrounded by the conveyance belt, the suction chamber including a plurality of suction ports disposed away from and opposed to a back surface of the conveyance belt;

a decompression chamber disposed along a direction perpendicular to a conveyance direction of the conveyed object and outside the space surrounded by the conveyance belt, the decompression chamber connected to the suction chamber;

a suction device disposed outside the space surrounded by the conveyance belt, the suction device creating a negative pressure state in the suction chamber via the decompression chamber; and a divider disposed away from the back surface of the conveyance belt between the plurality of suction ports and the back surface of the conveyance belt in the space surrounded by the conveyance belt, wherein the divider includes a plural of ventilation holes smaller in opening area than each of the plurality of suction ports.

2. The conveying device according to claim 1, further comprising a partition disposed to partition the suction chamber into a plurality of suction flow paths.

3. The conveying device according to claim 1, wherein the conveyance belt is an endless belt, and wherein a belt support supports the back surface of the conveyance belt.

4. The conveying device according to claim 1, further comprising a conveyor to convey the conveyed object so that the conveyed object relatively moves with respect to the front surface of the conveyance belt.

5. The conveying device according to claim 1, further comprising a flow guide to guide, toward the plurality of suction ports, air flowing into the space surrounded by the conveyance belt through the conveyance belt.

6. The conveying device according to claim 1, wherein an opening ratio of ventilation holes in a region in which the divider is opposed to the plurality of suction ports is smaller than an opening ratio of ventilation holes in a region in which the divider is not opposed to the plurality of suction ports.

7. The conveying device according to claim 1, wherein the suction chamber is vertically divided into an upper chamber portion and a lower chamber portion by a suction port plate, and the divider is disposed in the upper chat ber portion.

8. A drying device comprising the conveying device according to claim 1, wherein a blower applies wind to the conveyed object o dry the conveyed object.

9. A printing apparatus, comprising:

a liquid discharge device to discharge liquid onto a conveyed object; and the conveying device according to claim 1 to convey the conveyed object.

10. The printing apparatus according to claim 9, wherein the conveying device is disposed downstream from the liquid discharge device in a conveyance direction of the conveyed object.

11. The printing apparatus according to claim 9, further comprising a pre-processing unit disposed upstream from the liquid discharge device in a conveyance direction of the conveyed object, to apply a treatment liquid to the conveyed object before the liquid is discharged onto the conveyed object by the liquid discharge device, wherein the conveying device is disposed upstream from the liquid discharge device and downstream from the pre-processing unit in the conveyance direction of the conveyed object.

12. A conveying device to convey a conveyed object, the conveying device comprising:

a conveyancebelt having a front surface to support the conveyed object, the conveyance belt having an air-permeable structure;

a suction chamber disposed in a space surrounded by the conveyance belt, the suction chamber including a plurality of suction ports disposed away from and opposed to a back surface of the conveyance belt;

a decompression chamber disposed along a direction perpendicular to a conveyance direction of the conveyed object and outside the space surrounded by the conveyance belt, the decompression chamber connected to the suction chamber;

a suction device disposed outside the space surrounded by the conveyance belt, the suction device creating a negative pressure state in the suction chamber via the decompression chamber; and a divider disposed away from the back surface of the conveyance belt between the plurality of suction ports and the back surface of the conveyance belt in the space surrounded by the conveyance belt;

wherein the divider includes a plurality of ventilation holes smaller in opening area than each of the plurality of suction ports, and wherein the conveyance device further comprises a switcher to switch at least one suction port of the plurality of suction ports between a suctionable state in which an inside of the space surrounded by the conveyance belt can be sucked by the suction device via the at least one suction port and an unsuctionable state in which the inside of the space surrounded by the conveyance belt cannot be sucked by the suction device.

13. A conveying device to convey a conveyed object, the conveying device comprising:

a belt having a front surface to support the conveyed object, the belt having a plurality of belt suction ports;

a suction chamber including a suction port;

a divider facing the suction port and the a back surface of the conveyance belt, the divider including a plurality of ventilation holes smaller in opening area than the suction port; and a plurality of belt supporters facing the divider and the belt, to contact the back surface of the conveyance belt, the plurality of belt supporters being along a moving direction of the conveyance belt.

14. The conveying device according to claim 13, wherein the plurality of belt supporters has a curved surface facing the back surface of the conveyance belt, and wherein the curved surface curves in a direction perpendicular to the moving direction of the conveyance belt.

15. The conveying device according to claim 13, wherein the plurality of belt supporters is disposed away from an upper surface of the divider.

16. The conveying device according to claim 15, wherein the plurality of belt supporters faces the plurality of ventilation holes.

17. The conveying device according to claim 13, wherein the suction port extends along the moving direction of the conveying belt.

18. The conveying device according to claim 17, further comprising a plurality of suction ports, including the suction port, arranged perpendicular to the moving direction of the conveyance belt.

19. The conveying device according to claim 17, wherein the suction port faces at least one of the plurality of belt supporters.

20. A drying device, comprising:

a blower applies wind to a conveyed object; and the conveying device according to claim 13.

21. A printing apparatus, comprising:

a liquid discharge device to discharge liquid onto a conveyed object; and the conveying device according to claim 13 to convey the conveyed object.

* * * * *